US006661374B2

(12) United States Patent
Kim et al.

(10) Patent No.: US 6,661,374 B2
(45) Date of Patent: Dec. 9, 2003

(54) BASE TRANSCEIVER STATION HAVING MULTIBEAM CONTROLLABLE ANTENNA SYSTEM

(75) Inventors: Duk-Yong Kim, Kyungki-Do (KR); Young-Chan Moon, Kyungki-Do (KR); Yong-Sup Kil, Kyungki-Do (KR); Yoon-Bae Lee, Kyungki-Do (KR)

(73) Assignee: KMW Inc., Kyungki-Do (KR)

( * ) Notice: Subject to any disclaimer, the term of this patent is extended or adjusted under 35 U.S.C. 154(b) by 0 days.

(21) Appl. No.: 10/004,852

(22) Filed: Dec. 7, 2001

(65) Prior Publication Data

US 2002/0080068 A1 Jun. 27, 2002

(30) Foreign Application Priority Data

Dec. 8, 2000 (KR) ..... 2000-74843
Jan. 9, 2001 (KR) ..... 2001-1215
Jan. 10, 2001 (KR) ..... 2001-1401

(51) Int. Cl.[7] ..... H01Q 3/22; H01Q 3/24; H01Q 3/26

(52) U.S. Cl. ..... 342/372; 342/368; 342/373; 342/374

(58) Field of Search ..... 342/374, 372, 342/373, 368

(56) References Cited

U.S. PATENT DOCUMENTS 5,739,784 A * 4/1998 Jan et al. ..... 342/354
5,872,491 A 2/1999 Kim et al.
5,943,011 A * 8/1999 Acoraci et al. ..... 342/373
6,504,505 B1 * 1/2003 Yung ..... 342/374

* cited by examiner

*Primary Examiner*—Theodore M. Blum
(74) *Attorney, Agent, or Firm*—Greenblum & Bernstein, P.L.C.

(57) ABSTRACT

An antenna system for controlling multi beam independently and a base transceiver station using the same are disclosed. The multi beam controllable antenna system includes: at least one first dividing unit for dividing an input signal into a plurality of first divided signals; at least one first phase shifting unit for shifting the first divided signals and generating first phase-shifted signals; at least one first combining unit for combining the phase-shifted signals and generating a combined signal; at least one second dividing unit for dividing the combined signal into second divided signals; at least one second phase shifting unit for shifting the second divided signals and generating second phase-shifted signals; and a controlling unit for generating a control signal which controls horizontal and vertical half-power beam widths and tilting angles of the input signal independently by controlling the first and the second dividing unit and the first and the second phase shifting unit.

64 Claims, 28 Drawing Sheets

BASE TRANSCEIVER STATION HAVING MULTIBEAM CONTROLLABLE ANTENNA SYSTEM

FIELD OF THE INVENTION

The present invention relates to a base transceiver station in a radio communication system; and, more particularly, to a base transceiver station having a multi-beam controllable antenna system in a radio communication system, which varies a horizontal/vertical angle and a tilting angle according to variation in an amount of traffic within a sector.

DESCRIPTION OF THE PRIOR ART

From now on, a radio communication should support not only a voice service but also a high speed multimedia service including a data communication, a video transmission service, etc. However, radio resources necessary for the radio communication are limited. Therefore, various methods for effectively reusing the radio resources are being developed.

In general, a radio communication system includes a mobile switching center (MSC), a base station controller (BSC), a plurality of base transceiver stations (BTS) and a plurality of mobile stations (MS).

The MSC controls a plurality of the BSCs each controlling a plurality of the BTSs.

A signal radiated from the MS located in a service coverage of the BTS is transmitted to the MSC through the BTS and the BSC. On the contrary, a signal from the MSC is transmitted to the MS through the BSC and the BTS. Here, the BTS communicates with the MS through the radio resource and does with the BSC through the wired resource.

The BSC performs a connection between the BTS and the MSC and a signal processing for a communication between the BTS and the MSC.

The MSC performs a call processing of a subscriber, a call setup/release and functions for providing value added services.

FIG. 1 shows a conventional base transceiver station.

Referring to FIG. 1, the conventional base transceiver station includes fixed combiners 101-1 to 101-3, fixed dividers 103-1 to 103-3, amplifiers 105-11 to 105-34, combiners 107-1 to 107-3 and duplexers 109-1 to 109-3.

A service area of the BTS is divided into multiple sectors, and frequency assignments assigned to the BTS are re-assigned to the multiple sectors. The frequency assignment assigned to each sector is fixed in order to be used only for the sector.

In general, a beam pattern of an antenna is set to be wider than the service area as shown in FIG. 2A.

Referring to FIG. 2B, the FAs in each of the sectors are overlapped with each other, efficiency of frequency is considerably decreased in the overlapped region (denoted by oblique lines).

Since the mobile station always moves, distribution of subscribers in the service areas, i.e., a cell or a sector, always varies. However, a horizontal half-power beam width and a tilting angle of an antenna system located in the BTS are fixed and cannot be varied.

Therefore, though traffics in a certain sector is temporarily increased, the frequency assignments cannot be changed, thereby decreasing efficiency in use of the frequency resources.

In general, the antenna is located on a high location, which is remote from the BTS, and the antenna is coupled to the BTS by using a radio frequency (RF) cable. There is a transmission loss in the long RF cable. As the RF cable is longer, the transmission loss becomes larger.

There are a conventional mechanical down-tilting antenna system and a conventional electrical down-tilting antenna system. The mechanical down-tilting antenna system being capable of mechanically down-tilting a beam radiated from an antenna incorporated into the antenna system. The antenna is mounted atop a mast at a height above ground, e.g., in many cases about 200 feet.

In case when the orientation of a radiation beam is steered downward, the antenna must be mechanically down tilted. One of the major shortcomings is that this approach is generally regarded as too rigid and too expensive. There is an approach that electrically down-tilting the radiation beam is performed by steering the relative phases of the radiation associated with each of several radiators of an antenna.

The conventional electrical down-tilting antenna being capable of electrically down-tilting a beam 406 radiated from an antenna array incorporated into the antenna system. In the antenna system, the antenna array incorporates therein an array of radiators and a single point signal feed network provided with a scan network to couple the single point signal feed network to the antenna array of radiators. The scan network includes a plurality of transmission lines between the feed network and each radiator. Among these electrical down tilting method is a capacitive coupling method, in which an adjustable capacitance is placed in series with the transmission lines to provide a plurality of signals to each radiator of the antenna array, thus causing the desired phase shifts. A phase shifter is associated with each radiator of the antenna array such that the phase shifted beam from each radiator constructively interferes with the beam from every other radiator to produce a composite beam radiating at an angle from a line normal to the surface of the antenna. By changing the phase shift provided by each phase shifter, the beam can be scanned across the antenna surface. Another such approach is to use different lengths of transmission lines for feeding the different elements to produce a permanent electrical down tilting.

There are a number of problems associated with the above-described antenna systems. First of all, both of the antenna systems cannot steer a radiation beam in horizontal direction.

Another problem of the conventional antenna system is that it requires a number of phase shifters corresponding to the number of the transmission lines in the conventional antenna systems.

In addition, in the conventional antenna systems, it requires a mechanically complex, for example using a rack and pinion assembly or a number of phase shifters corresponding to the number of radiators, for providing the desired phase shift.

Further, the conventional antenna systems cannot steer a beam width in horizontal and in vertical, Finally, because a beam is scanned in vertical and in horizontal by utilizing the conventional antenna systems, it has too much scan loss.

Therefore, in order to keep an output power of a signal radiated from the antenna constant, an output power of a multi channel power amplifier (MCPA) in the BTS should be increased.

Since the MCPA is an expensive device, a high capacity MCPA makes the cost for the BTS increased.

SUMMARY OF THE INVENTION

It is, therefore, an object of the present invention to provide an antenna system capable of controlling multi beams of frequency assignments by independently varying a half-power beam width and a tilting angle in vertical and horizontal direction.

It is another object of the present invention to provide a method and a base transceiver station for controlling multi beams of frequency assignments by independently varying a half-power beam width and a tilting angle in vertical and horizontal direction.

It is another object of the present invention to provide an antenna system for electrically steering a beam emitted therefrom in horizontal by using a multi-line phase shifter.

It is another object of the present invention to provide an antenna system for selectively switching a beam width in horizontal by using a switchable divider.

It is another object of the present invention to provide an antenna system for minimizing interference and maximizing cell capacity.

It is another object of the present invention to provide an antenna system for providing an optimal cell planning and meeting the real world of diverse environments.

It is another object of the present invention to provide an antenna system capable of harmonizing with communication environment.

It is another object of the present invention to provide an antenna system with a stable installation.

In accordance with an aspect of the present invention, there is provided an antenna system for controlling multi beams of a transmission signal, comprising; at least one first dividing unit for dividing an input signal into a plurality of first divided signals; at least one first phase shifting unit for shifting the first divided signals and generating first phase-shifted signals, at least one first combining unit for combining the phase-shifted signals and generating a first combined signal; at least one second dividing unit for dividing the first combined signal into second divided signals; at least one second phase shifting unit for shifting the second divided signals and generating second phase-shifted signals; and a controlling unit for generating a control signal which controls horizontal and vertical half-power beam widths and tilting angles of the input signal independently by controlling the first and the second dividing unit and the first and the second phase shifting unit.

In accordance with another aspect of the present invention, there is provided an antenna system for receiving a signal, comprising: at least one dividing unit for dividing a signal received by the antenna array into a plurality of divided signals; at least one phase shifting unit for controlling phases of the divided signals and generating phase-shifted signals; a combining unit for combining the phase-shifted signals, generating a combined signal and outputting the combined signal; and a controlling unit for generating a control signal which controls the phase shifting unit and the combining unit.

In accordance with further another aspect of the present invention, there is provided a base transceiver station for controlling multi beams of a transmission signal, comprising: at least one first dividing unit for dividing an input signal into a plurality of first divided signals; at least one first phase shifting unit for shifting the first divided signals and generating first phase-shifted signals; at least one first combining unit for combining the phase-shifted signals and generating a first combined signal; at least one second dividing unit for dividing the first combined signal into second divided signals; at least one second phase shifting unit for shifting the second divided signals and generating second phase-shifted signals; and a controlling unit for generating a control signal which controls horizontal and vertical half-power beam widths and tilting angles of the input signal independently by controlling the first and the second dividing unit and the first and the second phase shifting unit.

In accordance with further another aspect of the present invention, there is provided a base transceiver station for receiving a signal, comprising: at least one dividing unit for dividing a signal received by the antenna array into a plurality of divided signals; at least one phase shifting unit for controlling phases of the divided signals and generating phase-shifted signals; a combining unit for combining the phase-shifted signals, generating a combined signal and outputting the combined signal; and a controlling unit for generating a control signal which controls the phase shifting unit and the combining unit.

In accordance with further another aspect of the present invention, there is provided a method for controlling multi beams of a transmission signal in an antenna system, comprising the steps of: a) at first dividing unit, dividing an input signal into a plurality of first divided signals; b) at first phase shifting unit, shifting the first divided signals and generating first phase-shifted signals; c) at first combining unit, combining the phase-shifted signals and generating a first combined signal; d) at second dividing unit, dividing the first combined signal into a plurality of second divided signals; e) at second phase shifting unit, shifting the second divided signals and generating second phase-shifted signals; and f) generating a control signal which controls horizontal and vertical half-power beam widths and tilting angles of the input signal independently by controlling the first and the second dividing unit and the first and the second phase shifting unit.

In accordance with further another aspect of the present invention, there is provided a method for controlling multi beams of a received signal in an antenna system, comprising the steps of: a) at dividing unit, dividing a signal received by the antenna array into a plurality of divided signals; b) at phase shifting unit, controlling phases of the divided signals and generating phase-shifted signals; c) at combining unit, combining the phase-shifted signals, generating a combined signal and outputting the combined signal; and d) generating a control signal which controls the phase shifting unit and the combining unit.

In accordance with further another aspect of the present invention, there is provided a method for controlling multi beams of a transmission signal in a base transceiver station, comprising the steps of: a) at first dividing unit, dividing an input signal into a plurality of first divided signals; b) at first phase shifting unit, shifting the first divided signals and generating first phase-shifted signals; c) at first combining unit, combining the phase-shifted signals and generating a first combined signal; d) at second dividing unit, dividing the first combined signal into a plurality of second divided signals; e) at second phase shifting unit, shifting the second divided signals and generating second phase-shifted signals; and f) generating a control signal which controls horizontal and vertical half-power beam widths and tilting angles of the input signal independently by controlling the first and the second dividing unit and the first and the second phase shifting unit.

In accordance with further another aspect of the present invention, there is provided a method for controlling multi beams of a received signal in a base transceiver station, comprising the steps of: a) at dividing unit, dividing a signal received by the antenna array into a plurality of divided signals; b) at phase shifting unit, controlling phases of the divided signals and generating phase-shifted signals; c) at combining unit, combining the phase-shifted signals, generating a combined signal and outputting the combined signal; and d) generating a control signal which controls the phase shifting unit and the combining unit.

BRIEF DESCRIPTION OF THE DRAWING

The above and other objects and features of the present invention will become apparent from the following description of the preferred embodiments given in conjunction with the accompanying drawings, in which.

DETAILED DESCRIPTION OF THE PREFERRED EMBODIMENTS

Hereinafter, referring to FIGS. 3 to 16C, an antenna system 100 for controlling a single beam in a radio communication in accordance with preferred embodiments of the present invention.

Figure 1:
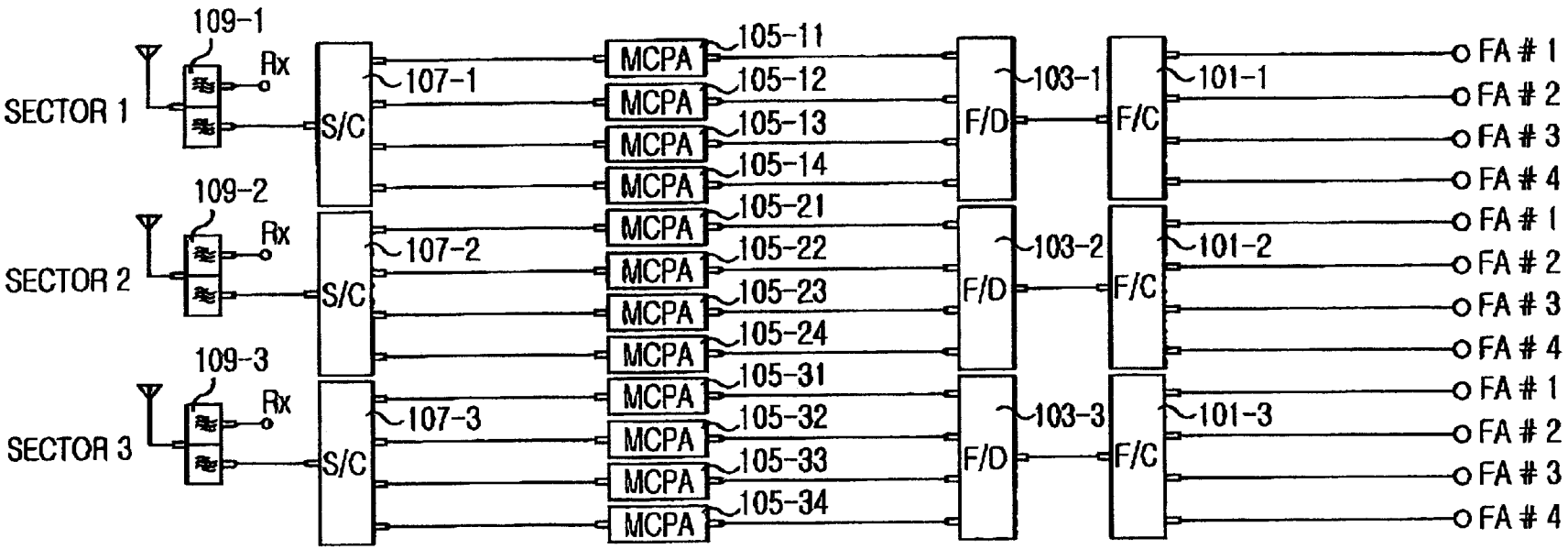
FIG. 1 (PRIOR ART)
FIG. 1 shows a diagram of a conventional base transceiver station.
Figure 2A:
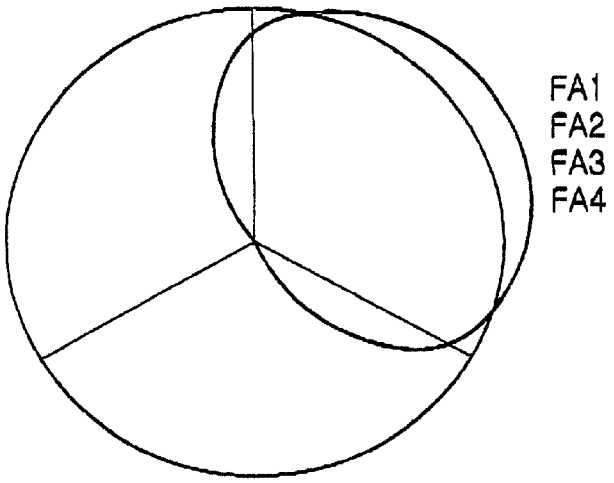
FIG. 2A (PRIOR ART)
FIGS. 2A and 2B depict beam patterns for beams emitted from a conventional antenna system.
Figure 2B:
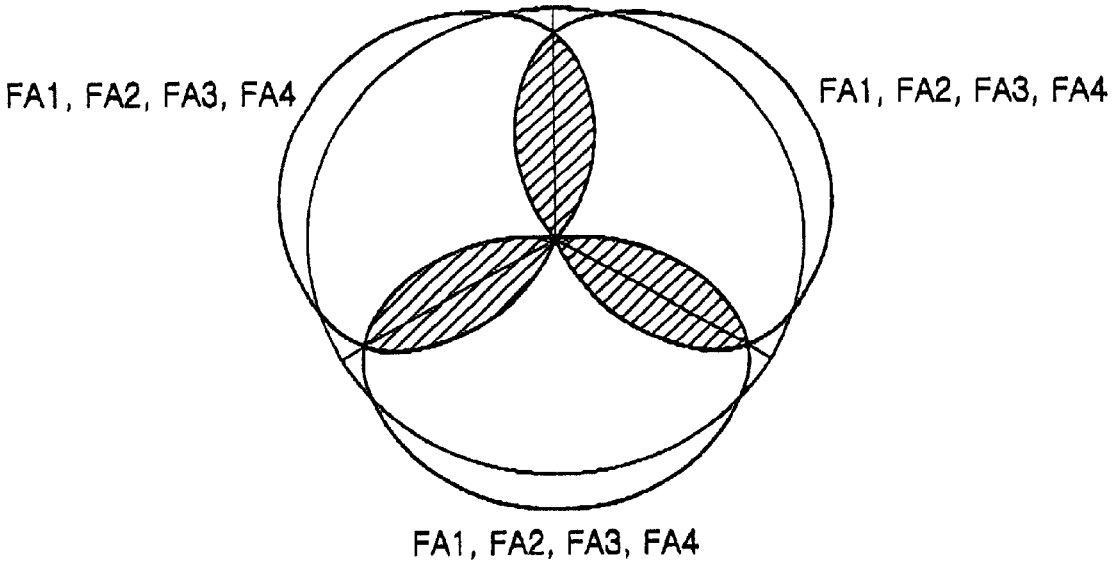
FIG. 2B (PRIOR ART)
Figure 3:
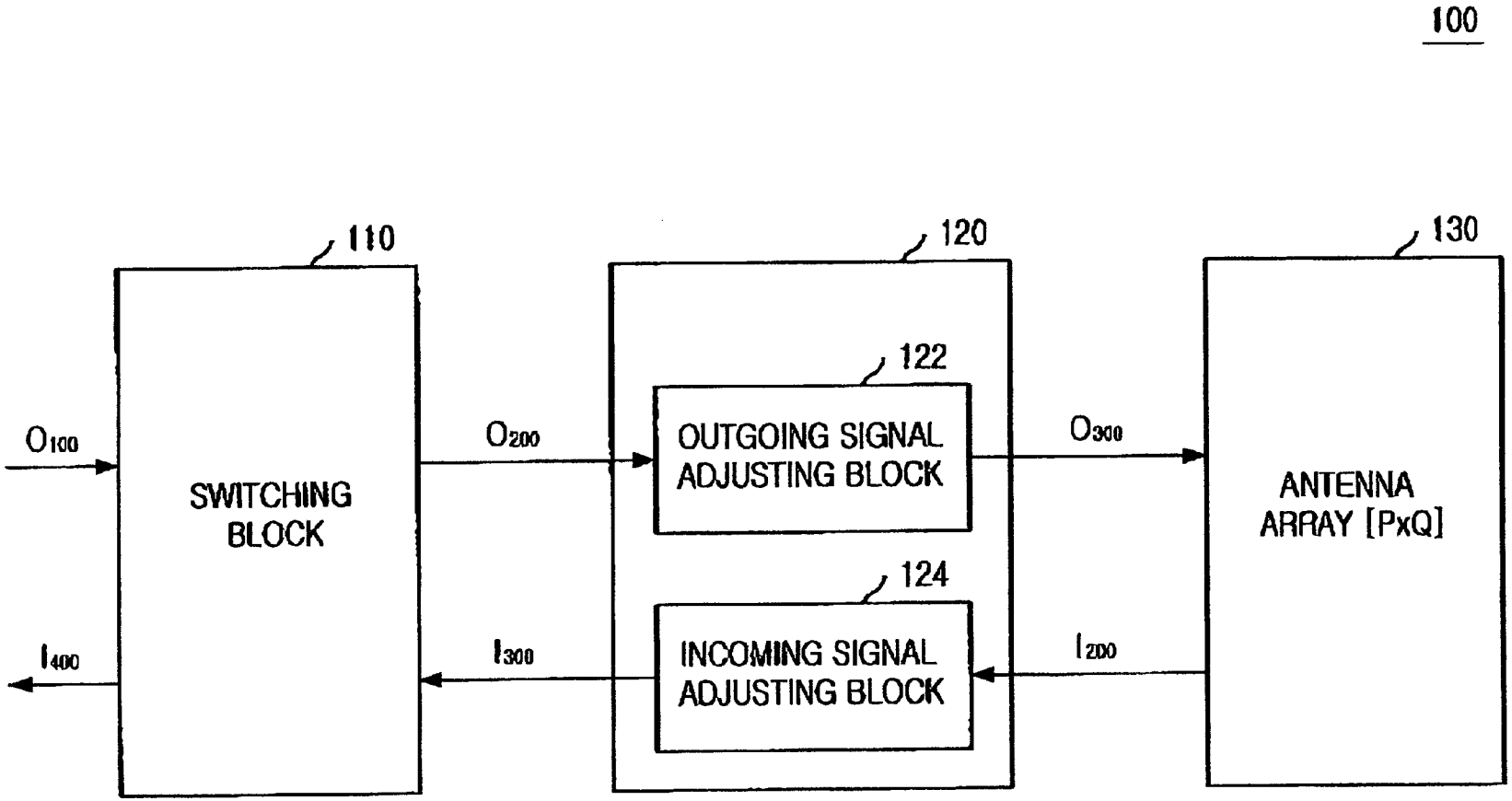
FIG. 3 is a block diagram showing an antenna system in accordance with the present invention.

In FIG. 3, there is provided a block diagram of an antenna system 100 for use in a radio communication system. The antenna system 100 comprises a switching block 110, a signal adjusting block 120 including an outgoing signal adjusting block 122 and an incoming signal adjusting block 124, and an antenna array 130 of P×Q radiators. Here, P and Q are positive integers, respectively. The antenna system 100 further comprises a control block 700 including a beam control board 710, a vertical motor driver 720 and a horizontal motor driver 730 (shown in FIG. 7).

Figure 4:
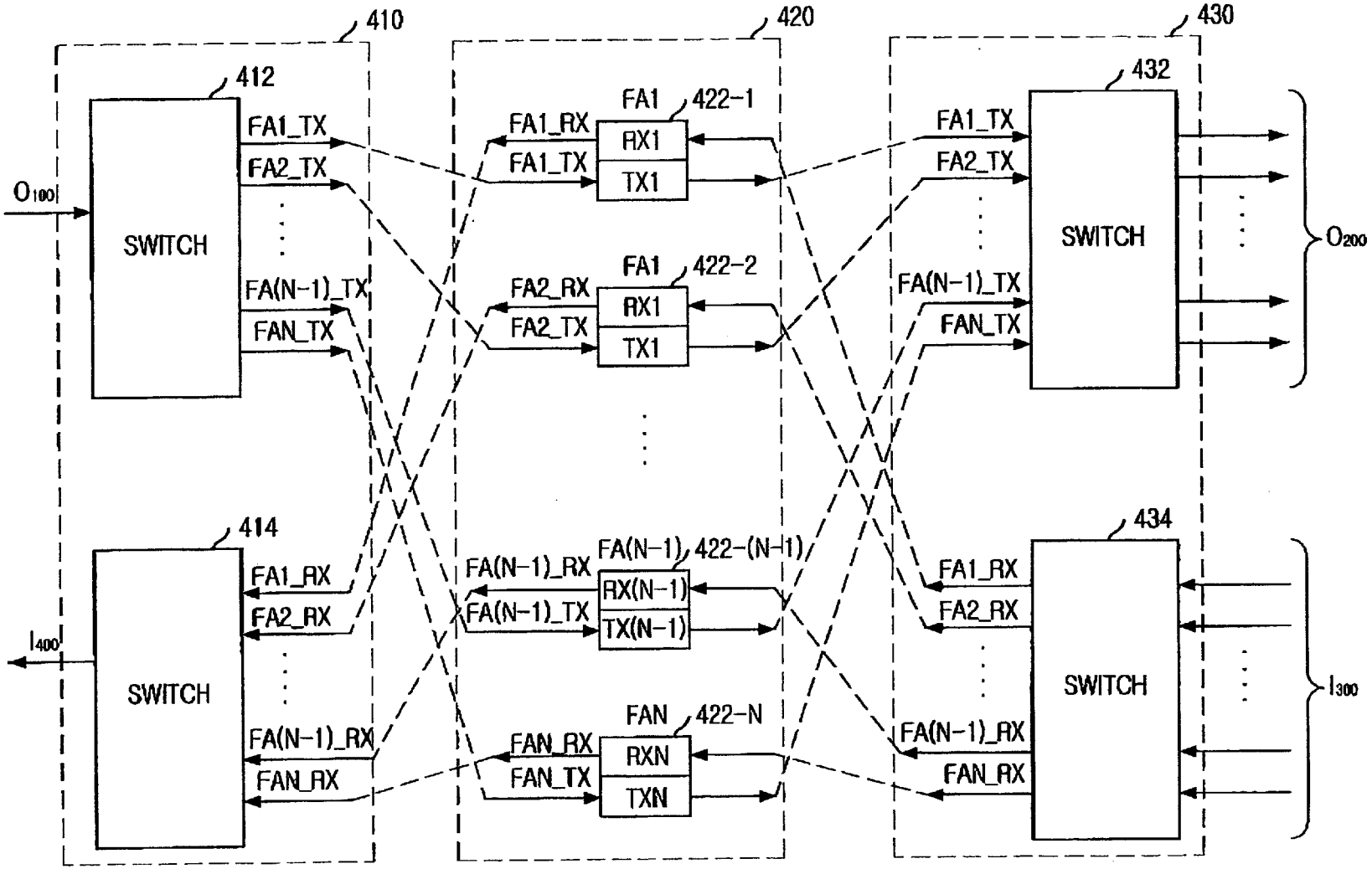
FIG. 4 is a block diagram showing a structure of a switching block in an antenna system.

FIG. 4 is a block diagram showing a structure of a switching block in an antenna system.

The switching block 110 includes a first switching block 410, an up/down converting block 420 and a second switching block 430.

The first switching block 410 includes a first switch 412 and a second switch 414.

The first switch 412 receives a first communication signal $O_{100}$ from the exterior thereof and transmits one or more first frequency signals, e.g., FA1_TX, FA2_TX . . . FA(N−1)_TX and FAN_TX separately to the up/down converting block 420 through respective output terminals thereof. The first frequency signals, FA1_TX, FA2_TX . . . FA(N−1)_TX and FAN_TX are based on the received first communication signal $O_{100}$ and have, respectively, a different frequency. The second switch 414 receives one or more second frequency signals, e.g., FA1_RX, FA2_RX . . . FA(N−1)_RX and FAN_RX from the up/down converting block 420 and transmits a second communication signal $I_{400}$ to the exterior thereof through its output terminal. The second frequency signals, FA1_RX, FA2_RX . . . FA(N−1)_RX and FAN_RX have, respectively, a different frequency. The second communication signal $I_{400}$ is generated based on the second frequency signals received from the up/down converting block 420.

As shown in this drawing, the up/down converting block 420 includes a multitude of up/down converters 422-1, 422-2 . . . 422-(N−1) and 422-N. At this point, the number of the up/down converters depends on how many frequency signals are received/transmitted from/to the first switching block 410. In other words, the number of the up/down converters is equal to that of the frequency signals received/transmitted from/to the first switching block 410.

Each up/down converter performs an up/down conversion process for signals inputted to therein, For example, when the up/down converting block 420 receives the first frequency signals from the first switch 412 of the first switching block 410, each up/down converter of the up/down converting block 420 performs the up/down conversion process for each of the first frequency signals corresponding thereto. Then, one or more third frequency signals that are generated according to the up/down conversion process are supplied to a third switch 432 of the second switching block 430.

On the contrary, when the up/down converting block 420 receives one or more fourth frequency signals from a fourth switch 434 of the second switching block 430, each up/down converter of the up/down converting block 420 performs the up/down conversion process for each of the fourth frequency signals corresponding thereto. Then, the second frequency signals that are generated according to the up/down conversion process are supplied to the second switch 414 of the first switching block 410.

The second switching block 430 includes the third switch 432 and the fourth switch 434.

The third switch 432 receives the third frequency signals from the up/down converting block 420 and transmits third communication signals $O_{200}$ separately to the outgoing signal adjusting block 122 (shown in FIG. 3). The third frequency signals include FA1_TX, FA2_TX . . . FA(N−1)_TX and FAN_TX for which the up/down conversion process are performed.

The fourth switch 434 receives second adjusted signals $I_{300}$ from the incoming signal adjusting block 124 (shown in FIG. 3) and transmits the fourth frequency signals correspondingly to the respective converters of the up/down converting block 420. The fourth frequency signals include FA1_RX, FA2_RX . . . FA(N−1)_RX and FAN_RX for which the up/down conversion process are to be performed.

Figure 5:
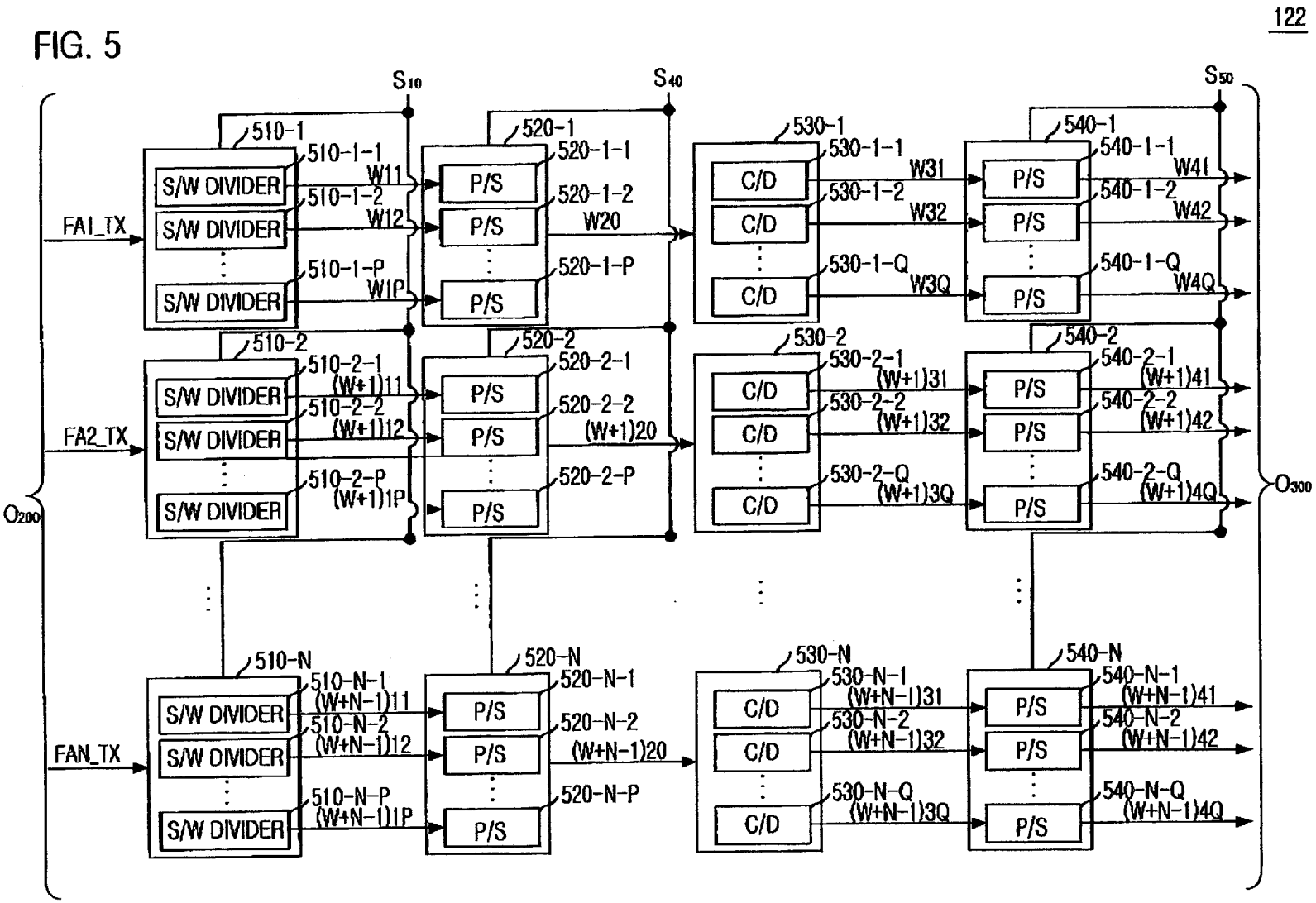
FIG. 5 is a block diagram showing a structure of an outgoing signal adjusting block in an antenna system.

FIG. 5 is a block diagram showing a structure of an outgoing signal adjusting block in an antenna system.

The outgoing signal adjusting block 122 receives the group of the second communication signals $O_{200}$ such as FA1_TX signal . . . and FAN_TX signal which are transmitted from the third switch 432. After adjusting the received signals $O_{200}$, it transmits one or more first adjusted signals $O_{300}$ to the antenna array 130.

As shown in FIG. 5, the outgoing signal adjusting block 122 includes one or more blocks of switchable dividers 510-1, 510-2 . . . 510-(N−1) and 510-N, one or more blocks of first phase shifters (P/S) 520-1, 520-2 . . . 520-(N−1) and 520-N, one or more blocks of first combiners/dividers (C/D) 530-1, 530-2 . . . 530-(N−1) and 530-N, and one or more blocks of second phase shifters (P/S) 540-1, 540-2 . . . 540-(N−1) and 540-N.

At this point, the number of each block of the switchable dividers, the first phase shifters, the first combiners/dividers and the second phase shifters is equal to the number of the up/down converters included in the up/down converting block 420.

Each block of switchable dividers 510-1 to 510-N includes P number of switchable dividers. As shown in this drawing, for example, a first block of switchable dividers 510-1 includes P number of switchable dividers 510-1-1 to 510-1-P.

Each block of first phase shifters 520-1 to 520-N includes P number of first phase shifters. For example, a first block of first phase shifters 520-1 includes P number of first phase shifters 520-1-1 to 520-1-P.

Each block of first combiners/dividers (C/D) 530-1 to 530-N includes Q number of first C/Ds. For example, a first block of first C/Ds 530-1 includes Q number of first C/Ds 530 1-1 to 530-1-Q.

Each block of second phase shifters (P/S) 540-1 to 540-N includes Q number of second P/Ss. For example, a first block of second P/Ss 540-1 includes Q number of second P/Ss 540-1-1 to 540-1-Q.

Figure 6:
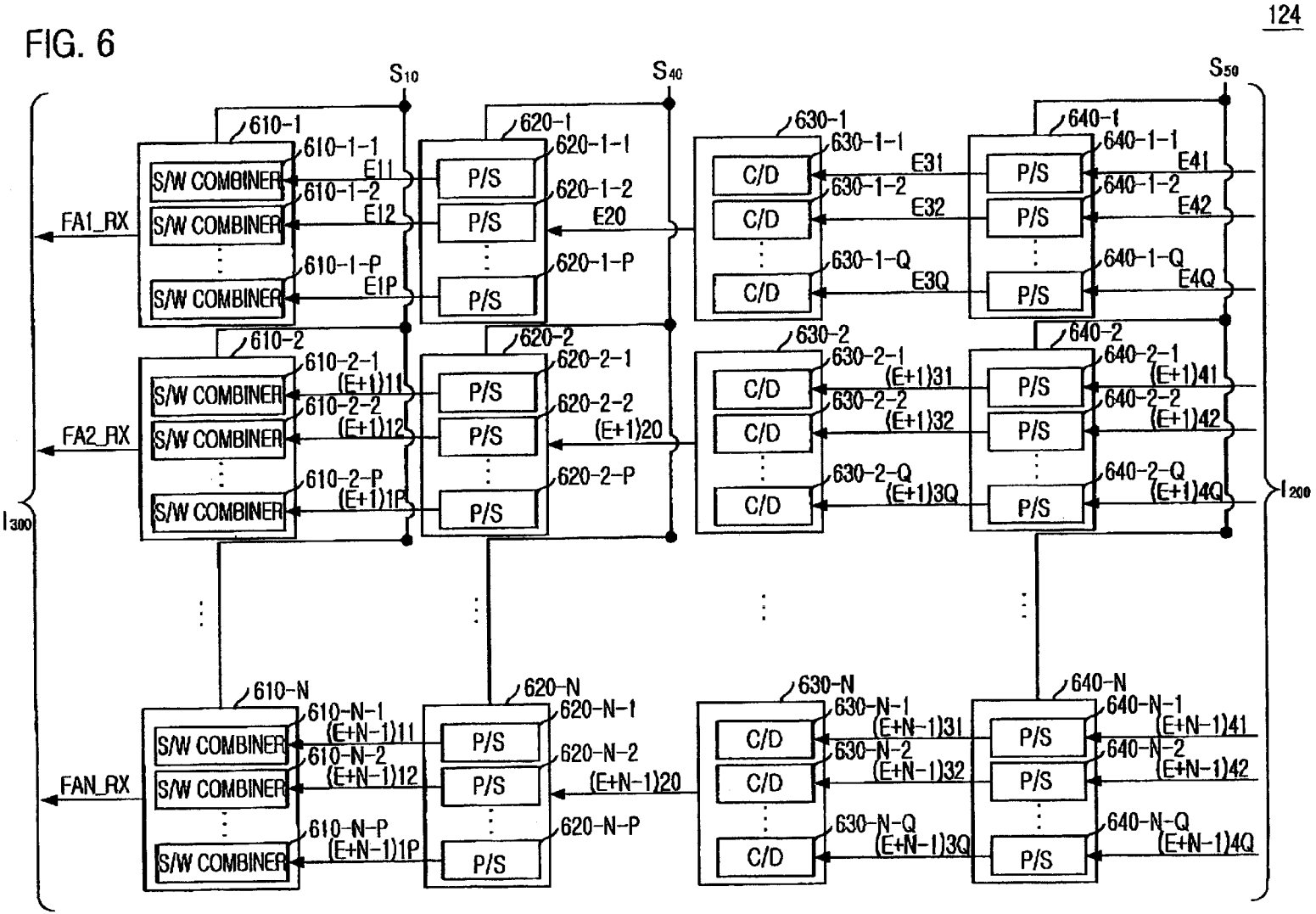
FIG. 6 is a block diagram showing a structure of an incoming signal adjusting block in an antenna system.

FIG. 6 is a block diagram showing a structure of an incoming signal adjusting block in an antenna system.

The incoming signal adjusting block 124 receives one or more fourth communication signals $I_{200}$ from the antenna array 130. After adjusting the same, it transmits second adjusted signals $I_{300}$ such as FA1_RX signal . . . and FAN_RX signal to the fourth switch 434 of the second switching block 430.

As shown in FIG. 6, the incoming signal adjusting block 124 includes one or more blocks of switchable combiners 610-1, 610-2 . . . 610-(N−1) and 610-N, one or more blocks of third phase shifters (P/S) 620-1, 620-2 . . . 620-(N−1) and 620-N, one or more blocks of second combiners/dividers (C/D) 630-1, 630-2 . . . 630-(N−1) and 630-N, and one or more blocks of fourth phase shifters (P/S) 640-1, 640-2 . . . 640-(N−1) and 640-N.

At this point, the number of each block of the switchable combiners, the third phase shifters, the second combiners/dividers and the fourth phase shifters is equal to the number of the up/down converters included in the up/down converting block 420.

Each block of switchable combiners 610-1 to 610-N includes P number of switchable combiners. As shown in this drawing, for example, a first block of switchable combiners 610-1 includes P number of switchable combiners 610-1-1 to 610-1-P.

Each block of third phase shifters 620-1 to 620-N includes P number of third phase shifters. For example, a first block of third phase shifters 620-1 includes P number of third phase shifters 620-1-1 to 620-1-P.

Each block of second combiners/dividers (C/D) 630-1 to 630-N includes Q number of second C/Ds. For example, a first block of second C/Ds 630-1 includes Q number of second C/Ds 630-1-1 to 630-1-Q.

Each block of fourth phase shifters (P/S) 640-1 to 640-N includes Q number of fourth P/Ss. For example, a first block of fourth P/Ss 640-1 includes Q number of fourth P/Ss 640-1-1 to 640-1-Q.

Figure 7:
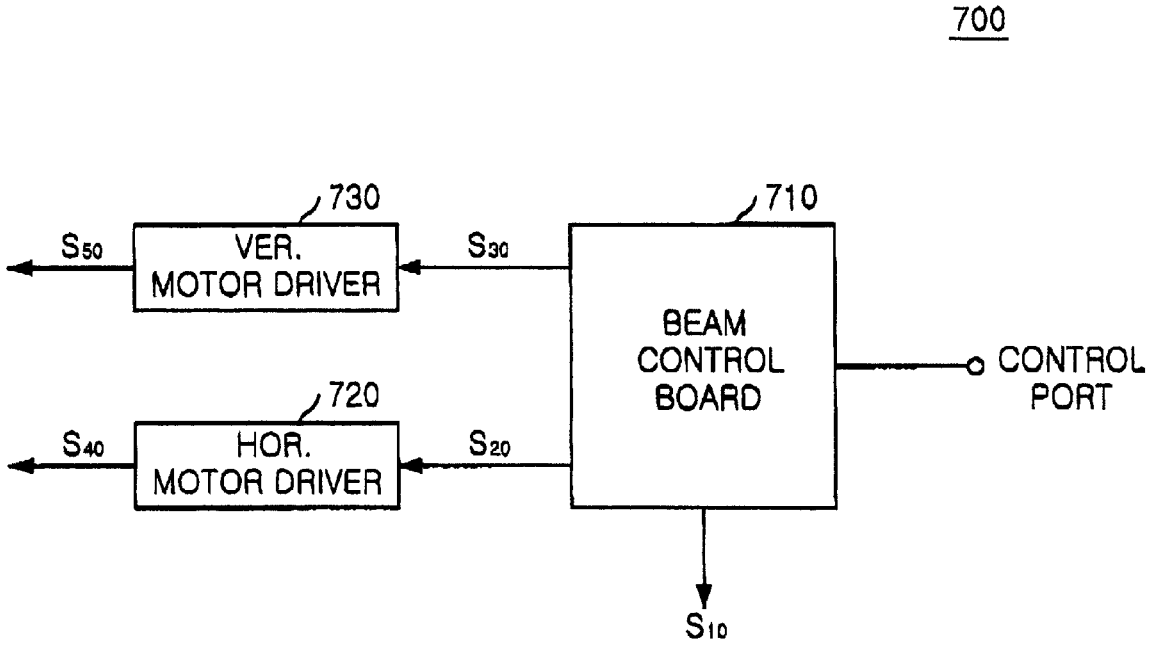
FIG. 7 is a block diagram showing a structure of a control block in an antenna system.

FIG. 7 is a block diagram showing a structure of a control block in an antenna system.

The control block 700 includes a beam control board 710, a horizontal motor driver 720 and a vertical motor driver 730.

When a control signal is inputted to the beam control board 710 through a control port thereof, the beam control board 710 generates a first control signal $S_{10}$, a second control signal $S_{20}$ and a third control signal $S_{30}$. The first control signal $S_{10}$ is used for horizontal beam width switching (HBWSw), the second control signal $S_{20}$ is used for horizontal beam steering (HBSt) and the third control signal $S_{30}$ is used for vertical beam down titling (VBDT).

Figure 8:
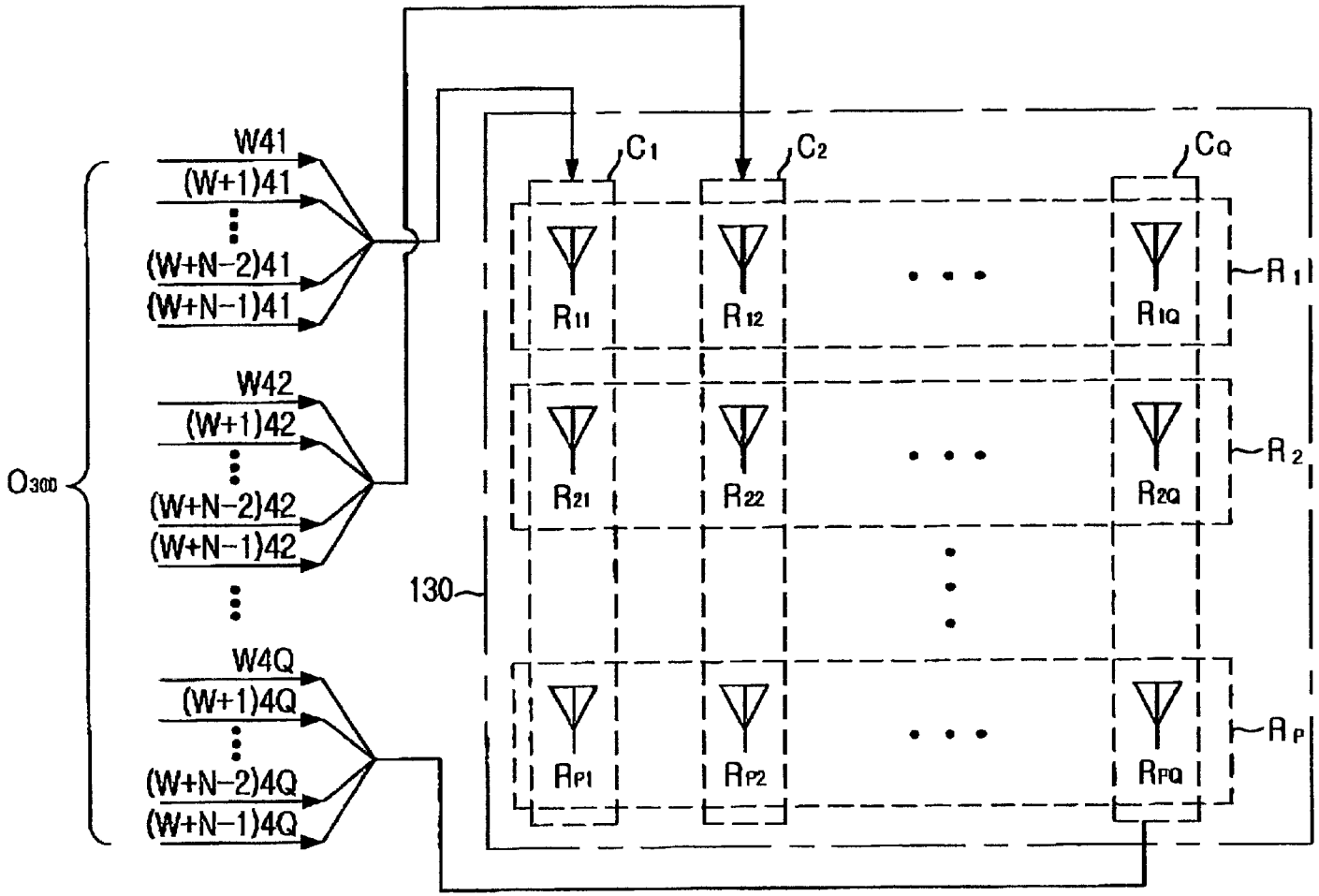
FIG. 8 is a block diagram showing an antenna array in transmitting signals out of an antenna system.
Figure 9:
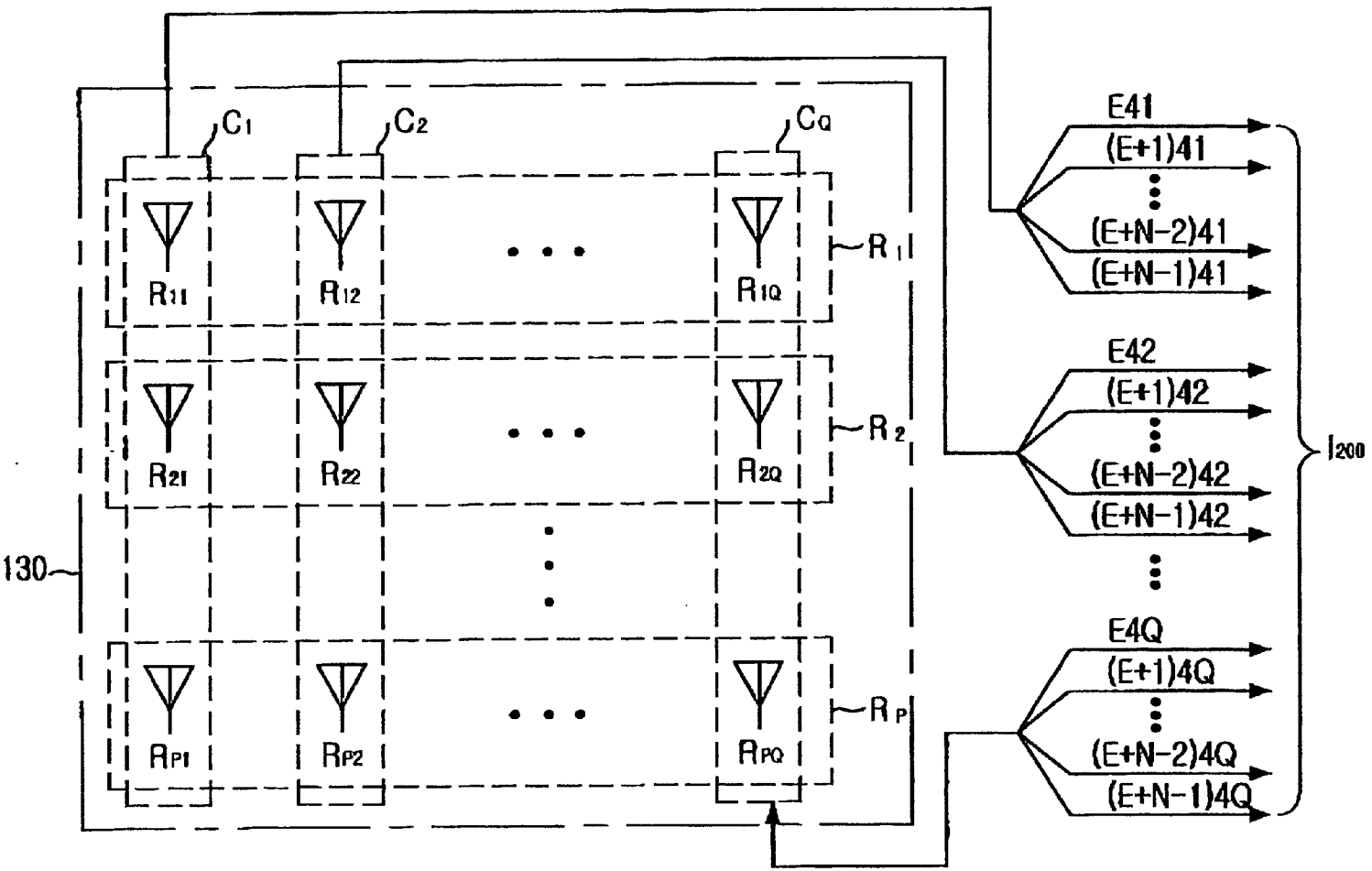
FIG. 9 illustrates a block diagram of an antenna array in receiving signals from the outside of the antenna system.

FIGS. 8 and 9 are block diagrams each showing an antenna array in an antenna system.

Particularly, FIG. 8 shows an antenna array in transmitting signals out of an antenna system and FIG. 9 shows the antenna array in receiving signals from the outside of the antenna system thereto.

The antenna array 130 of P×Q radiators, wherein P and Q are positive integers, respectively.

Referring to FIG. 8, the antenna array 130 receives one or more first adjusted signals $O_{300}$ from the outgoing signal adjusting block 122 and then transmits the adjusted signals $O_{300}$ out of the antenna system.

In case where the antenna array 130 receives the first adjusted signals $O_{300}$ from the outgoing signal adjusting block 122, the first adjusted signals are transmitted out of the antenna system through corresponding P number of radiators included in each of the columns $C_1$ to $C_Q$.

For example, parts of the adjusted signals $O_{300}$, W41, (W+1)41 . . . (W+N−2)41 and (W+N−1)41 from respective phase shifters 540-1-1, 540-2-1 . . . 540-(N−1)-1 and 540-N-1 are radiated through the radiators included in the column $C_1$. Also, another parts of the adjusted signals $O_{300}$, W4Q, (W+1)4Q . . . (W+N−2)4Q and (W+N−1)4Q from respective phase shifters 540-1-Q, 540-2-Q . . . 540-(N−1)-Q and 540-N-Q are radiated through the radiators included in the column $C_Q$.

Referring to FIG. 9, the antenna array 130 receives a plurality of radio signals from the exterior of the antenna system and then transmits the radio signals to the incoming signal adjusting block 124.

For example, parts of the fourth communication signals $I_{200}$ from the outside of the system, E41, (E+1)41 . . . (E+N−2)41 and (E+N−1)41 are transmitted to the respective phase shifters 640-1-1, 640-2-1 . . . 640-(N−1)-1 and 640-N-1, wherein the parts of the signals are received through the radiators included in the column $C_1$. Also, another parts of the fourth communication signals $I_{200}$, E4Q, (E+1)4Q . . . (E+N2)4Q and (E+N−1)4Q are transmitted to the respective phase shifters 640-1-Q, 640-2-Q . . . 640-(N−1)-Q and 640-N-Q through the radiators included in the column $C_Q$.

Figure 10:
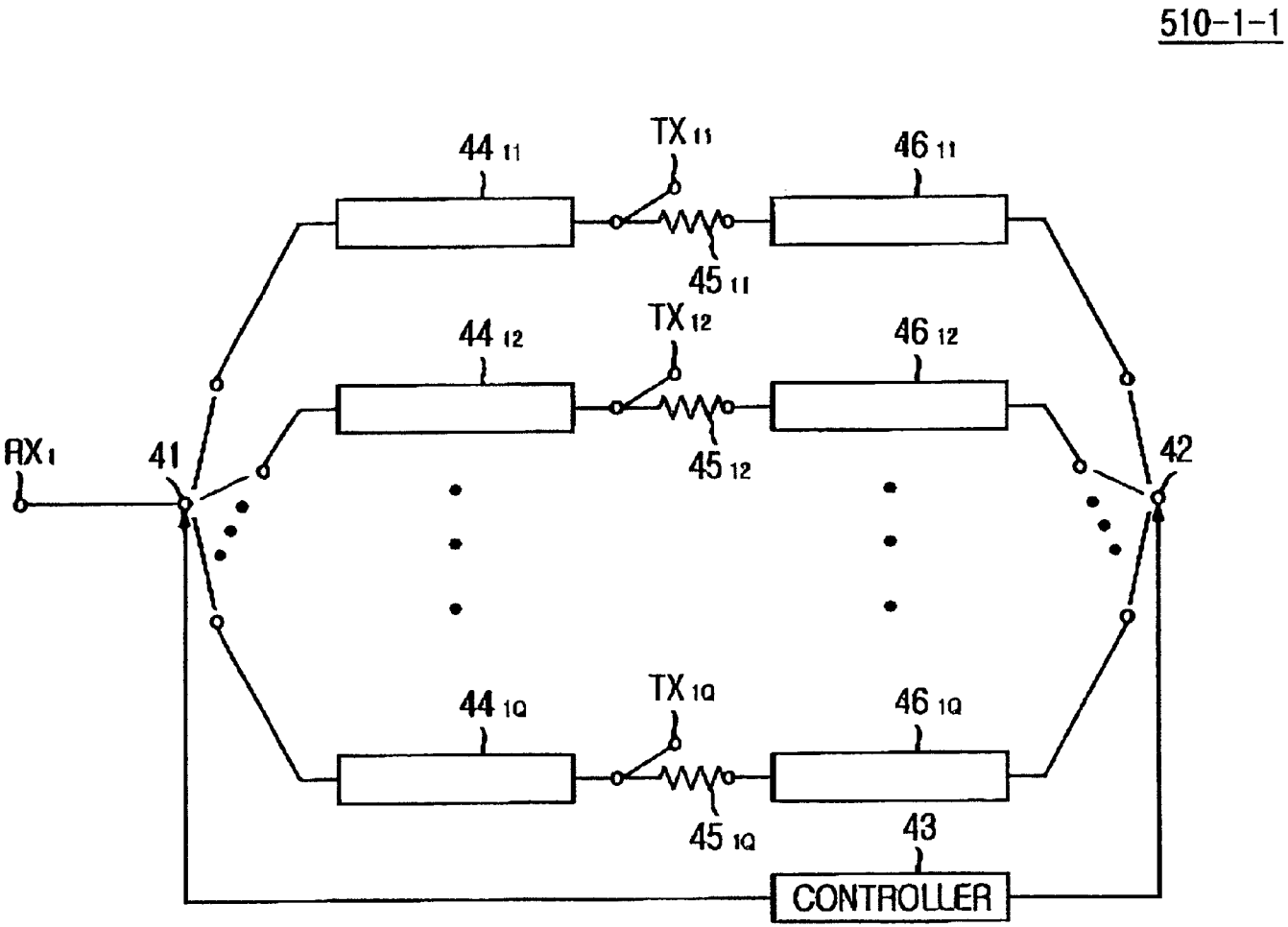
FIG. 10 illustrates a diagram of a switchable divider included in a switching block in an antenna system.

FIG. 10 illustrates a switchable divider included in a switching block in an antenna system.

Let the switchable divider shown in this drawing represent a switchable divider 510-1-1 included in the first block of switchable dividers 510-1.

The switchable divider 510-1-1 includes an input port $RX_1$ for receiving an RF signal from the input port, first transmission lines $44_{11}$–$44_{1Q}$, second transmission lines $46_{11}$–$46_{1Q}$, isolation resistors $45_{11}$–$45_{1Q}$, output ports $TX_{11}$–$TX_{1Q}$, a first switch 41 and a second switch 42. The switchable divider 510-1-1 is described in a Q-way operating mode. In the preferred embodiment, the switchable divider 510-1-1 operates as a divider to equally divide the RF signal into Q number of output signals at a maximum operating mode. The switchable divider 510-1-1 can vary its operating rode based on the first control signal $S_{10}$ from the beam control board 710. The switchable divider 510-1-1 is described in detail in U.S. Pat. No. 5,872,491 issued Feb. 16, 1999 and owned by the same applicant, which is incorporated herein by reference.

Figure 16A:
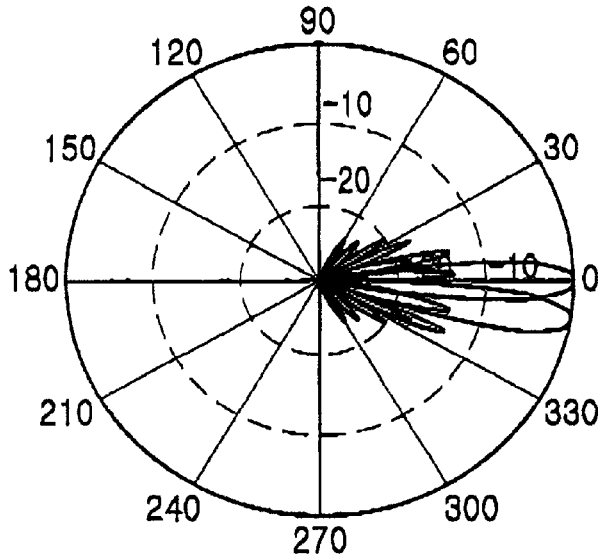
FIG. 16A plots a beam pattern for electrically down tilting a beam emitted from an antenna system in accordance with the present invention.
Figure 16B:
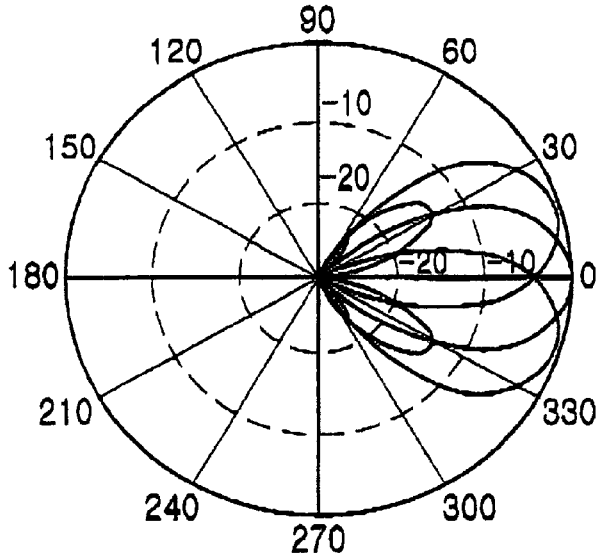
FIG. 16B plots a beam pattern for horizontally steering a beam emitted from an antenna system in accordance with the present invention.
Figure 16C:
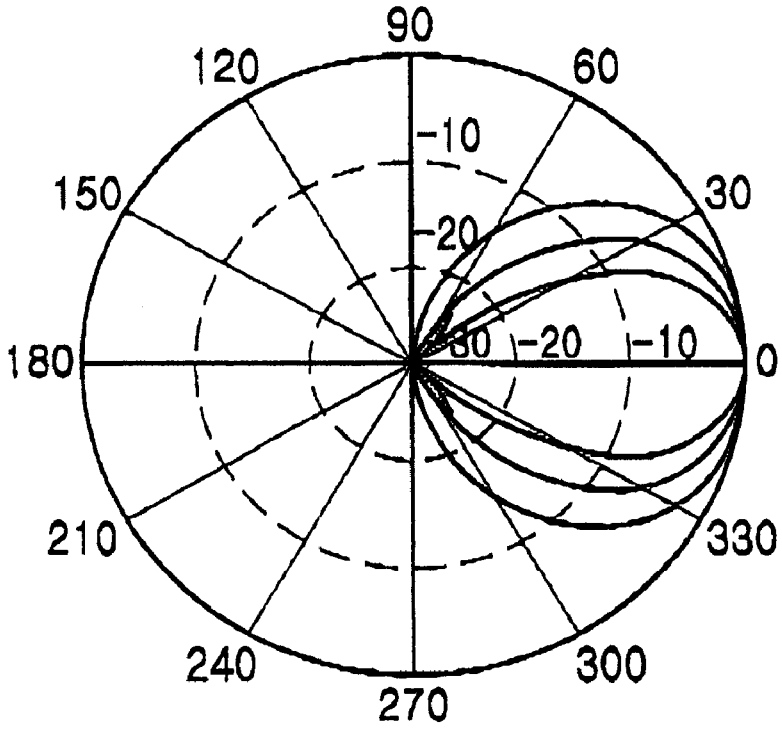
FIG. 16C plots a beam pattern for horizontally switching a beam width emitted from an antenna system in accordance with the present invention.

Referring back to FIGS. 5 and 7, each of the switchable dividers 510-1-1 to 510-1-P provides a plurality of divided signals to the first P/Ss 520-1-1 to 520-1-P through lines W11 to W1P, respectively. In each of the switchable dividers 510-1-1 to 510-1-P, the number of divided signals is equal to that of the operating modes. In the preferred embodiment, the antenna system 100 can modulate a beam width emitting from its antenna array 130 by changing the number of operating modes. The simulation data are shown in FIGS. 16A to 16C.

On the other hand, the horizontal motor driver 720 generates P number of motor control signals in response to the second control signal S20 from the beam control board 710. Each motor control signal (S40 shown in FIG. 7) is inputted to a corresponding first P/S and used for rotating a dielectric member incorporated into the corresponding first P/S.

Figure 11:
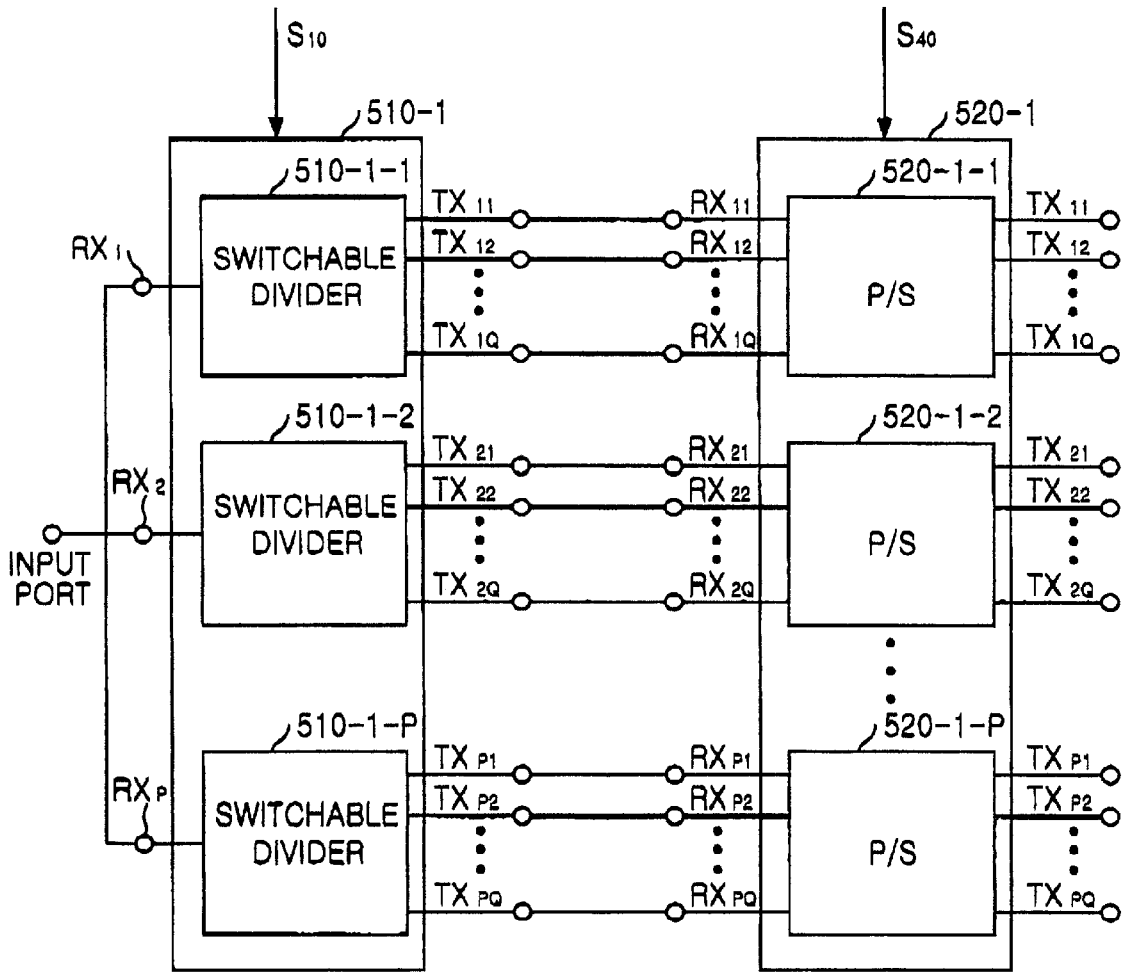
FIG. 11 illustrates a relationship of signal transmission/reception between a switchable divider block and a first phase shifter block.

FIG. 11 illustrates a relationship of signal transmission/reception between a block of switchable dividers and a block of first phase shifters.

Referring to FIG. 11, each of the divided signals from the output ports $TX_{11}$ to $TX_{PQ}$ of the first block of switchable dividers 510-1 is inputted to a corresponding input port of the first block of first P/Ss 520-1. For example, the divided signals from $TX_{11}$ to $TX_{1M}$ are inputted to $RX_{11}$ to $RX_{1M}$ of the first phase shifter 520-1-1.

Figure 12:
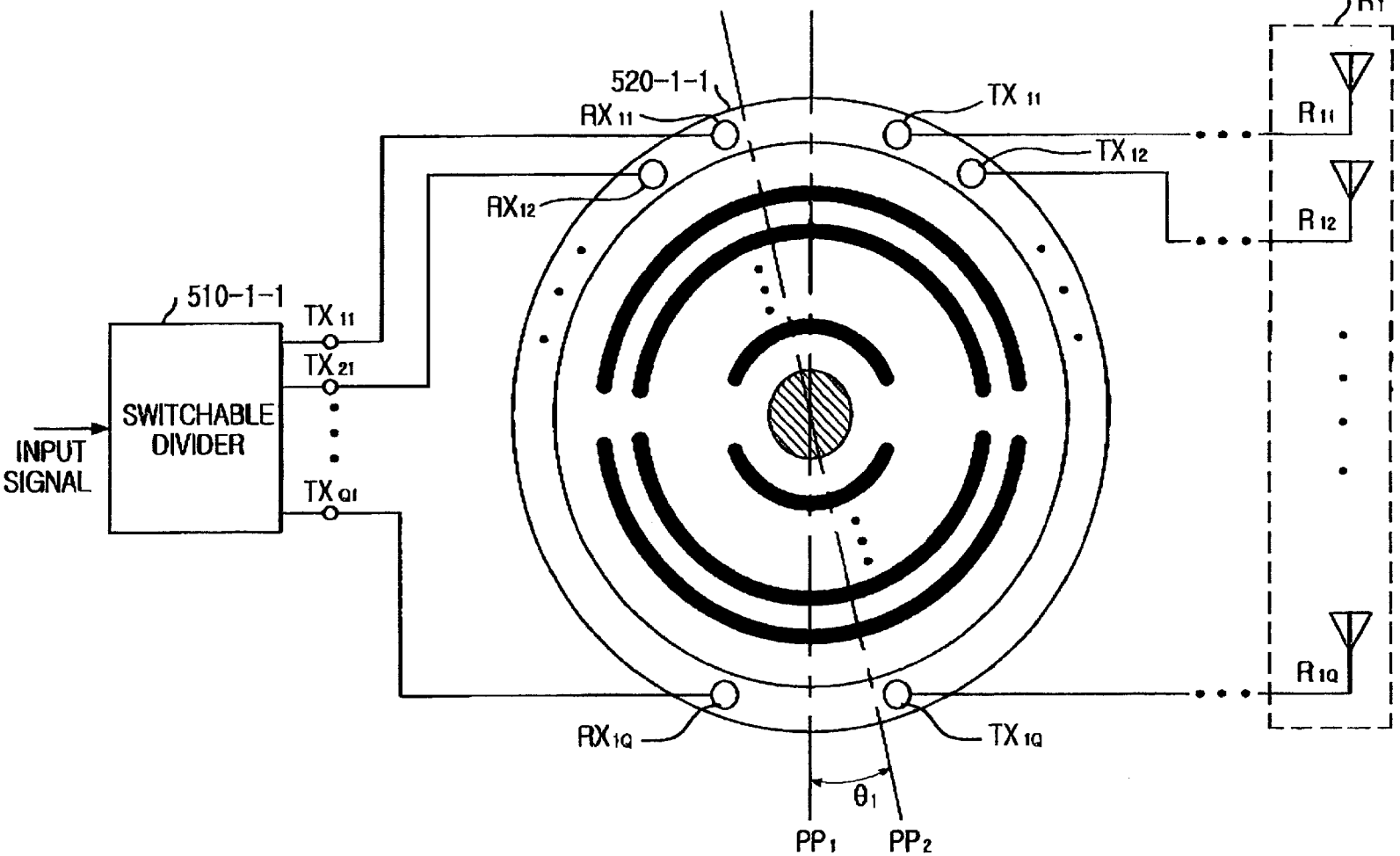
FIG. 12 illustrates a relationship of signal transmission/reception between a first phase shifter and its neighbor elements.
Figure 13:
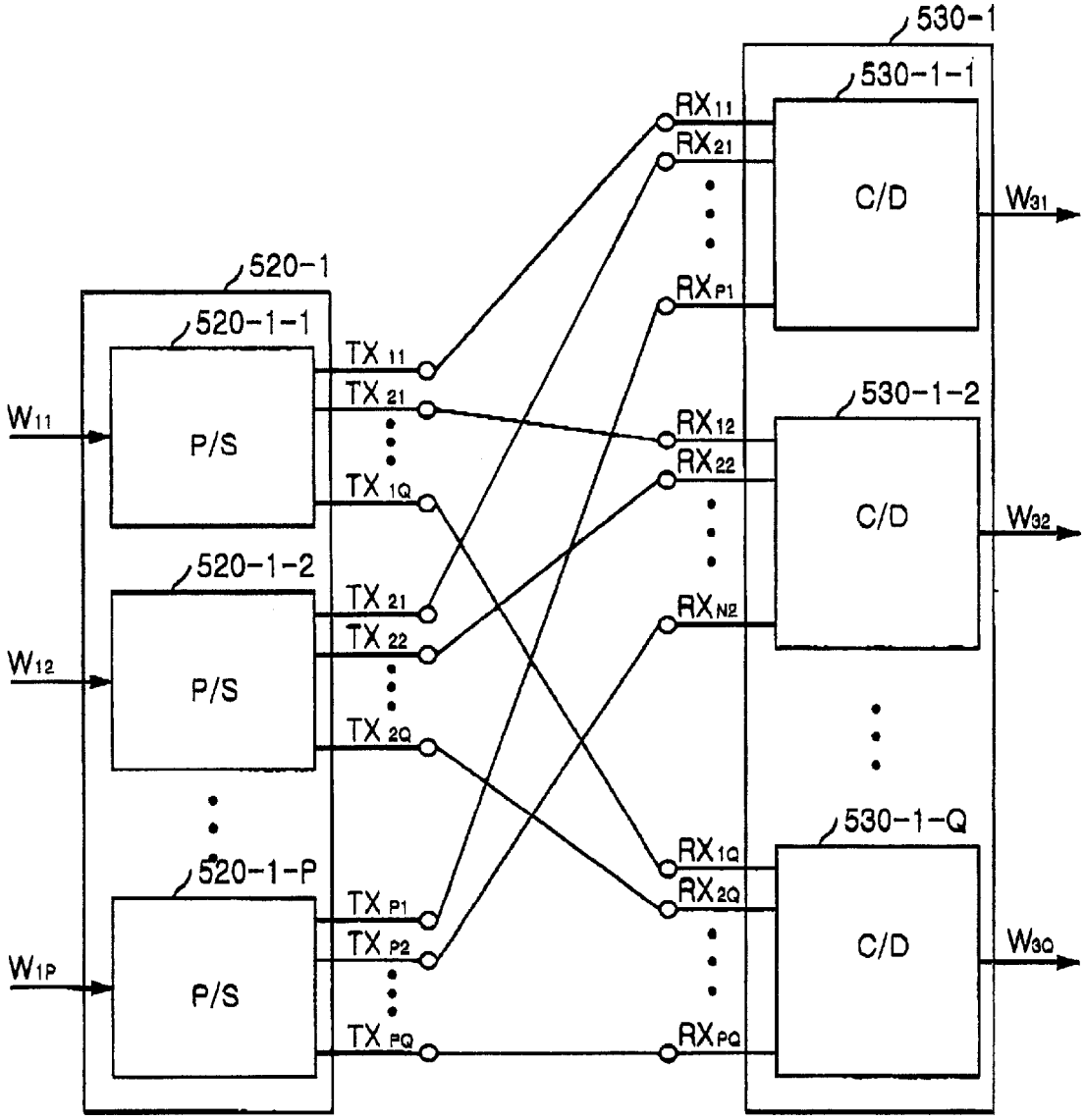
FIG. 13 illustrates a relationship of signal transmission/reception between a combiner/divider block and a first phase shifter block.

FIG. 12 illustrates a relationship of signal transmission/reception between a first phase shifter and its neighbor elements.

Referring to FIG. 12, there is shown a detailed diagram representing a relationship between the first phase shifter 520-1-1 and neighbor elements. The first phase shifter 520-1-1 includes a dielectric member (not shown), Q number of transmission lines, Q number of input ports $RX_{11}$ to $RX_{1Q}$ and Q number of output ports $TX_{11}$ to $TX_{1Q}$. As shown in this figure, it is possible to simultaneously modulate phases of the divided signals from the switchable divider 510-1-1 by rotating the dielectric member at a predetermined angle $\theta_1$. The electrical lengths of the transmission lines located at a half portion increase to a predetermined degree, those of the other portion decrease to the predetermined degree, simultaneously. The first P/S 520-1-1 is described in detail in U.S. patent application Ser. No. 09/798,908 filed on Mar. 6, 2001 by the same applicant, entitled: "SIGNAL PROCESS APPARATUS FOR PHASE-SHIFTING N NUMBER OF SIGNALS INPUTTED THERETO", which is incorporated herein by reference.

In the preferred embodiment, each of the first P/Ss 520-1-1 to 520-1-P can implement a horizontal beam steering. For example, if the horizontal motor driver 720 send a motor control signal to the first P/S 520-1-1 to rotate the dielectric member at the predetermined angle $\theta_1$. Half of divided signals from the switchable divider 510-1-1 are phase-shifted in advance and the other are phase-delayed after passing through the first P/S 520-1-1. Therefore, in the row $R_1$ of the antenna array 130, each of the radiators $R_{11}$ to $R_{1M}$ receives a different signal, which is linearly symmetric with respect to a center point of the row $R_1$. That is, the antenna can electrically steering a beam emitted from the row $R_1$ in horizontal based on the rotation of the dielectric member.

The phase-shifted signals W20 are transmitted to the first block of first C/Ds 530-1. The detailed description is described with reference to FIG. 12. The first phase shifters 520-1-1, 520-1-2 . . . and 520-1-P include output ports $TX_{11}$ to $TX_{1Q}$, $TX_{21}$ to $TX_{2Q}$ and $TX_{P1}$ to $TX_{PQ}$, respectively. And also, the CDs 530-1-1, 530-1-2 and 530-1-Q include input ports $RX_{11}$ to $RX_{P1}$, $RX_{12}$ to $RX_{P2}$ and $RX_{1Q}$ to $RX_{PQ}$, respectively. Each of the phase-shifted signals from the output ports $TX_{11}$ to $TX_{PQ}$ is transmitted to a corresponding input port. For example, if a phase-shifted signal from the output port $TX_{12}$ of the first block of first P/Ss 520-1 is transmitted to the input port $RX_{12}$ of the first block of the C/Ds 530-1. That is, an output port $TX_{PQ}$ is connected to an input port $RX_{PQ}$ in such a way that the sub-index of the output port $TX_{PQ}$ corresponds to that of the input port $RX_{PQ}$.

Each of the C/Ds 530-1-1 to 530-1-Q transmits the phase-shifted signals W31 to W3Q from the first P/Ss 520-1-1 to 520-1-P to the corresponding second phase shifter, as shown in FIG. 5. Each of the second phase shifter 540-1-1 to 540-1-Q transmits the signals from the first block of first C/Ds 530-1.

Figure 14:
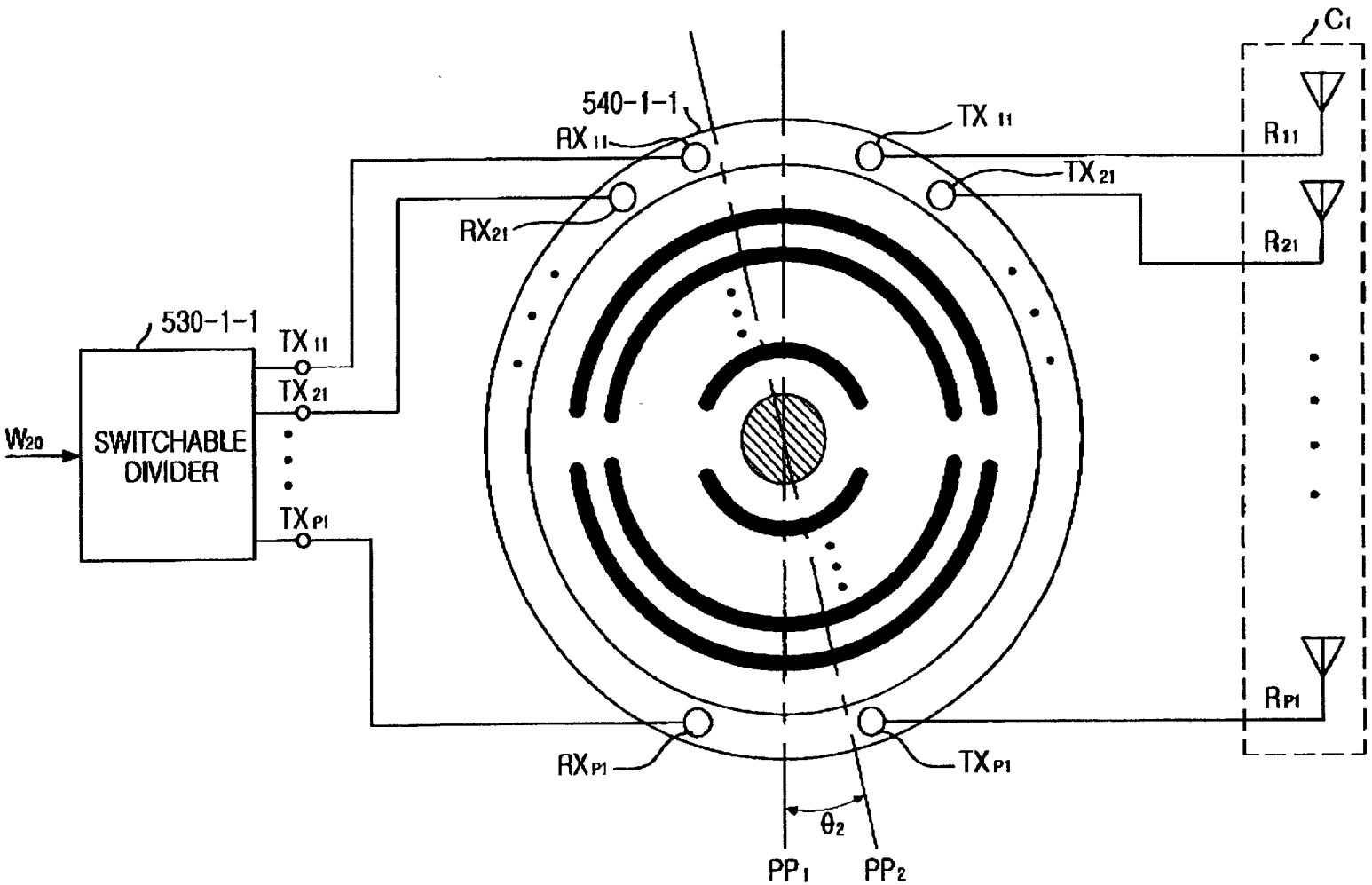
FIG. 14 illustrates a relationship of signal transmission/reception between a second phase shifter and its neighbor elements.

FIG. 14 illustrates a relationship of signal transmission/reception between a second phase shifter and its neighbor elements.

Referring to FIG. 14, there is shown a detailed diagram representing a relationship between the second phase shifter 540-1-1 and neighbor element shown. The function and the structure of the second P/S 540-1-1 is similar to those of the first P/S 520-1-1 except that the second P/S 540-1-1 has P number of transmission lines. And also, it is possible to simultaneously modulate phases of signals inputted to the input ports $RX_{11}$ to $RX_{P1}$ by rotating the dielectric member at a predetermined angle $\theta_2$. The electrical lengths of the transmission lines located at a half portion increase to a predetermined degree, those of the other portion decrease to the predetermined degree, simultaneously.

Down tilting is used to decrease a cell size from a beam shape directed to the horizon to the periphery of the cell. This provides a reduction in beam coverage, yet allows a greater number of users to operate within a cell since there is a reduction in the number of interfering signals. In the preferred embodiment, this down tilting can be obtained by rotating the dielectric members incorporated into the second P/S 540-1-1 to 540-1-Q for each column $C_1$ to $C_Q$. Specifically, in accordance with the preferred embodiment of the present invention, the signals inputted through half of the input ports $RX_{11}$ to $RX_{(P-1)/21}$ are shifted in advance and the signals inputted through the input ports $RX_{P/21}$ to $RX_{P1}$ are delayed in phase after passing through the output ports $TX_{11}$ to $TX_{P1}$. The amount of shifted phase has a linear symmetry with respect to the center points of each column $C_1$–$C_Q$ due to a symmetric arrangement of the second phase shifter.

Figure 15:
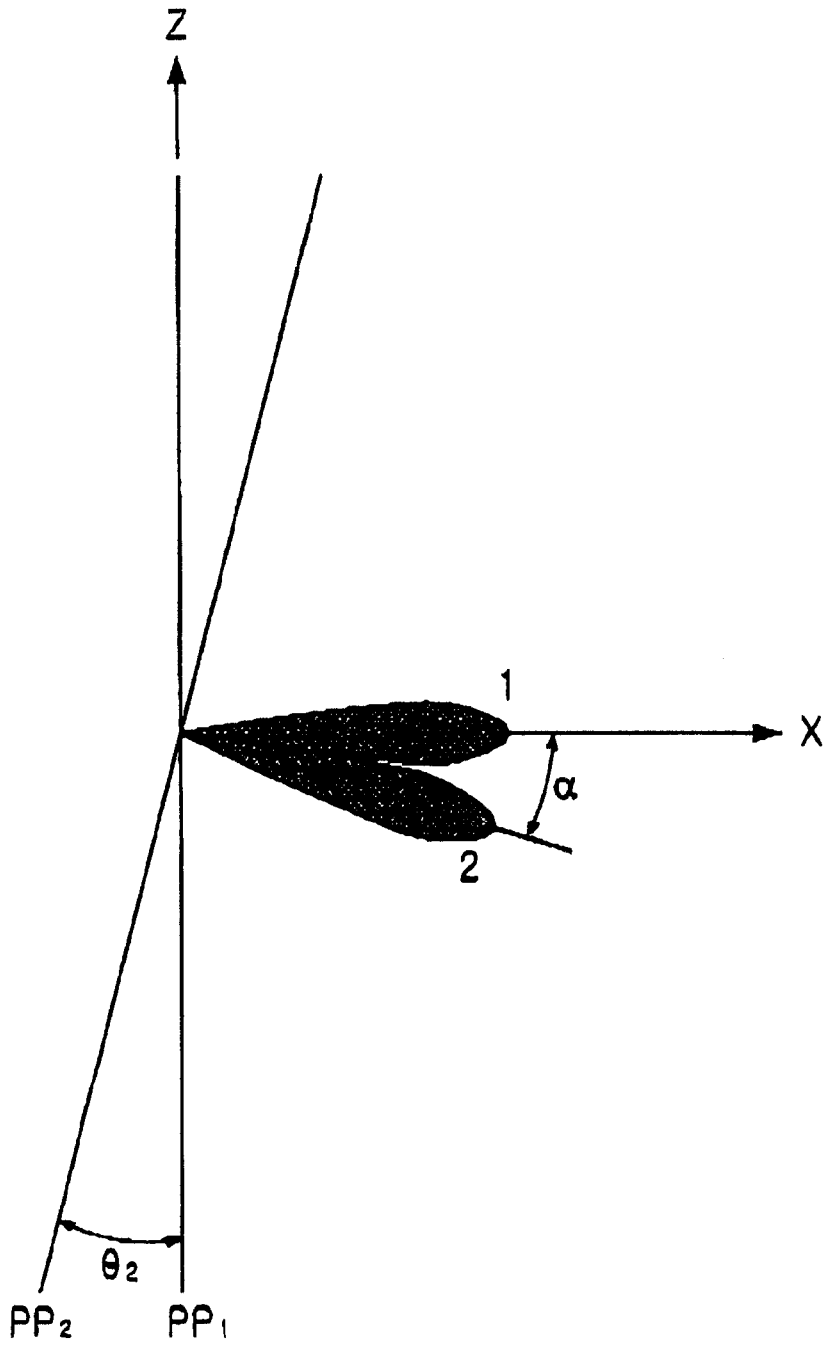
FIG. 15 is a schematic representation of a beam from an antenna system carried out a down-tilt in accordance with the present invention.

FIG. 15 is a schematic representation of a beam from an antenna system carried out a down-tilt in accordance with the present invention.

Referring to FIG. 15, if the second P/S does not rotates the dielectric member, the signals outputted from the output ports $TX_{11}$ to $TX_{1N}$ are located at a phase plane $PP_1$. In this case, the beam radiated from the array 130 of the radiators $R_{11}$ to $R_{QP}$ has a beam pattern $BP_1$. Whereas, if the second P/S rotates the dielectric member to the predetermined angle $\theta_2$, the signals outputted from the output ports $TX_{11}$ to $TX_{P1}$ are located at a phase plane $PP_2$. Therefore, the beam radiated from the array 130 of the radiators $R_{11}$ to $R_{PQ}$ has a beam pattern $BP_2$ which is rotated $\alpha$ degrees from the beam pattern $BP_1$.

FIG. 16A plots a beam pattern for electrically down tilting a beam emitted from an antenna system in accordance with the present invention.

Referring to FIG. 16A, there are shown antenna gain plots on polar coordinate in the horizontal plane at the level of the antenna when the antenna system 100 implements the down tilting with rotating the dielectric members of the second P/Ss 540-1-1 to 540-1-Q.

FIG. 16B plots a beam pattern for horizontally steering a beam emitted from an antenna system in accordance with the present invention.

In this drawing, shown are antenna gain plots on polar coordinate in the horizontal plane when the antenna system 100 implements the horizontal beam steering with rotating the dielectric members of the first P/Ss 520-1-1 to 520-1-P.

FIG. 16C plots a beam pattern for horizontally switching a beam width emitted from an antenna system in accordance with the present invention.

As shown in this drawing, plotted is an antenna gain when the antenna system 100 implements the horizontally beam width switching. In this case, the antenna array 130 is made of radiators $R_{11}$ to $R_{84}$ for applying IMT-2000. That is the number of columns is 4 and the number of rows is 8. The first block of first phase shifters 520-1 has only one first phase shifter in order to control all of the rows in the same manner. Therefore, the first block of switchable dividers 510-1 has one switchable divider. The switchable divider is set to operate at 4-way at a maximum operating mode. As can be shown, when the switchable divider operates at 4-way, the beam radiated from the array 130 has a HPBW (half power beam width) to be approximately 32 degrees. If the switchable divider operates at 3-way, the beam has HPBW to be approximately 45 degrees. The switchable divider operates at 2-way, the beam has HPBW to be approximately 64 degrees.

With reference to FIGS. 17 to 24, antenna systems and base transceiver stations having the same antenna system which can control multi beams of input signals, and multi beam controlling method will be described.

Figure 17A:
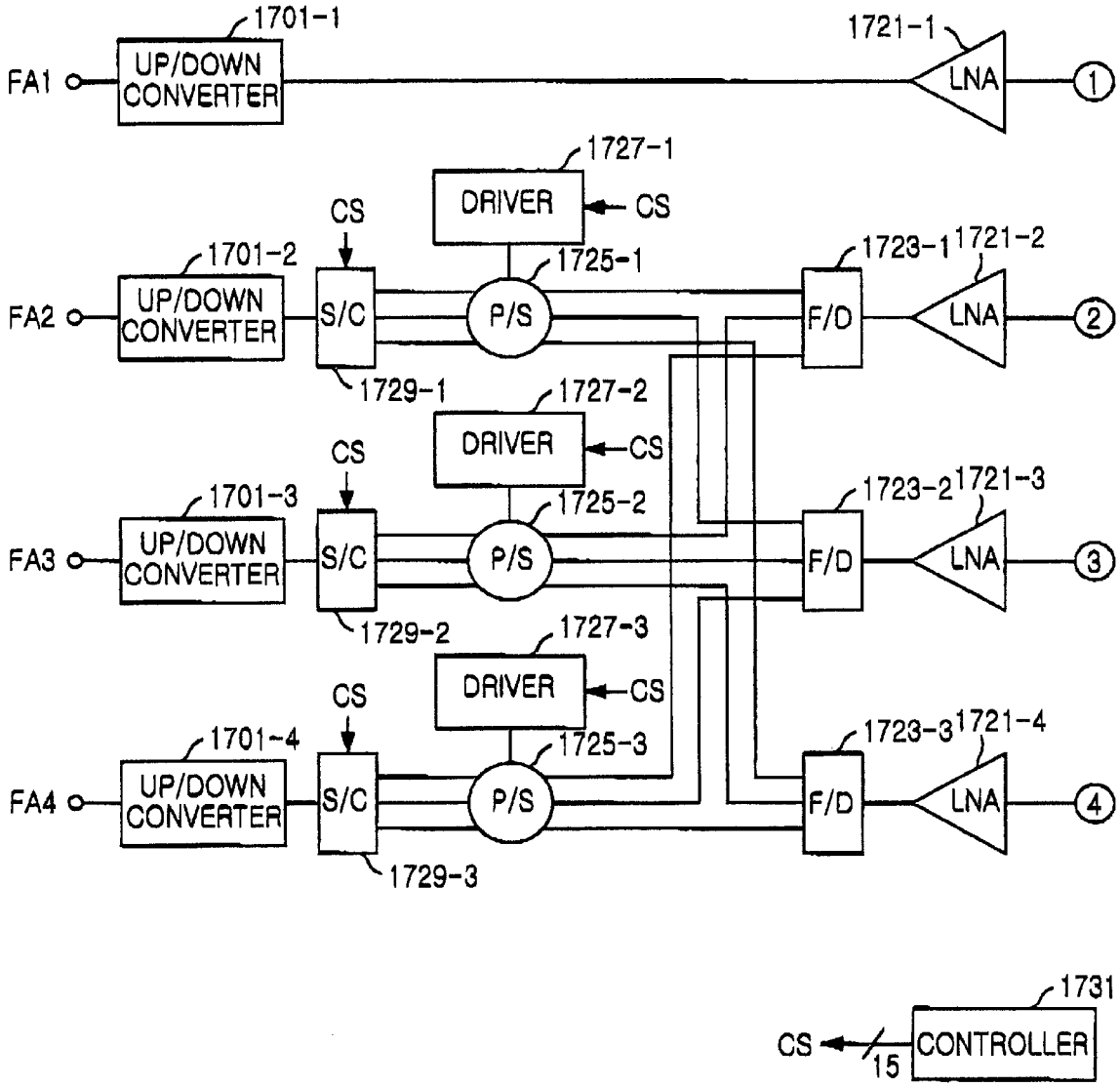
FIGS. 17A and 17B show diagrams of an antenna system capable of controlling multi beams of frequency assignments (FA) independently in accordance with the present invention.
Figure 17B:
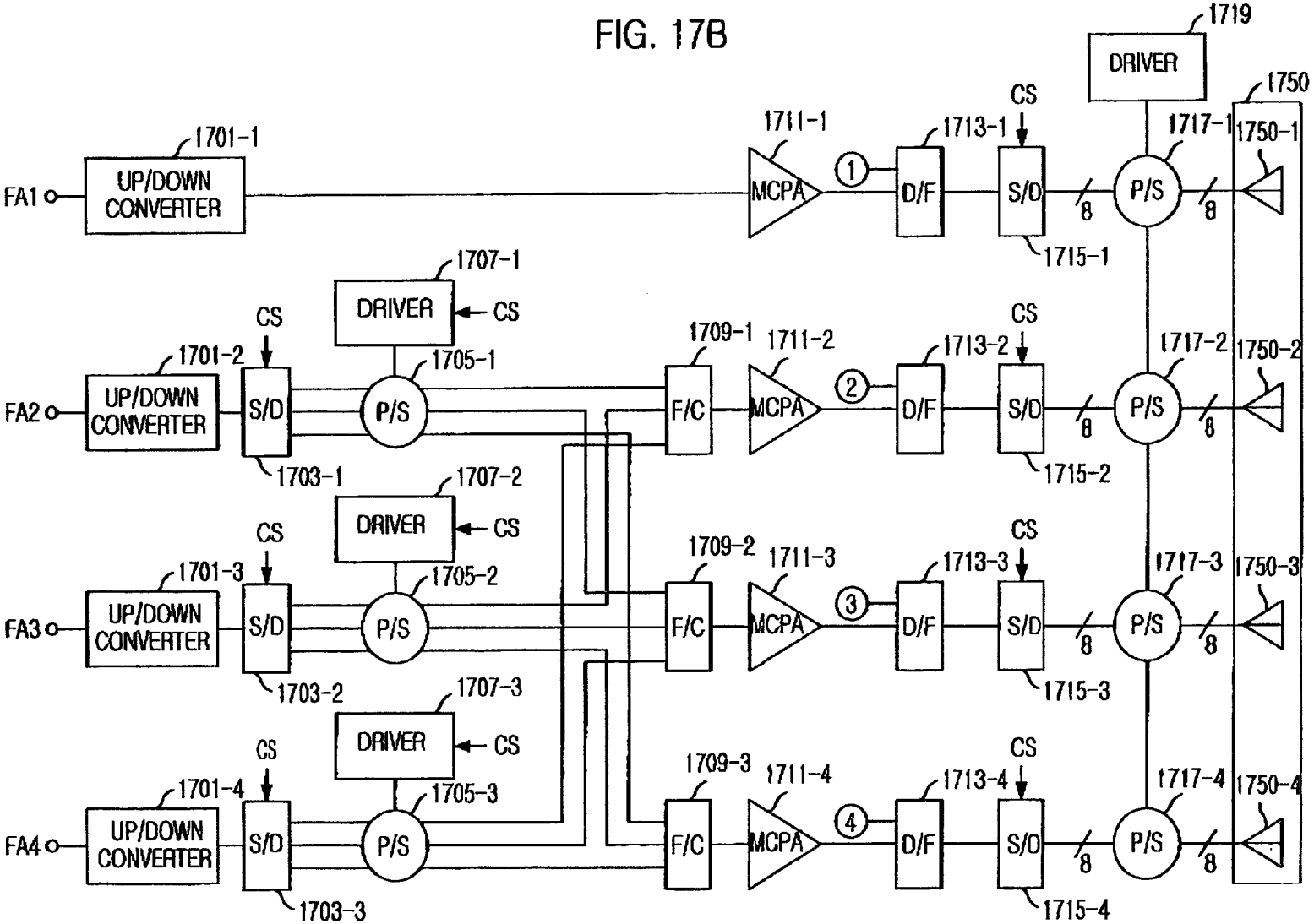
Figure 18A:
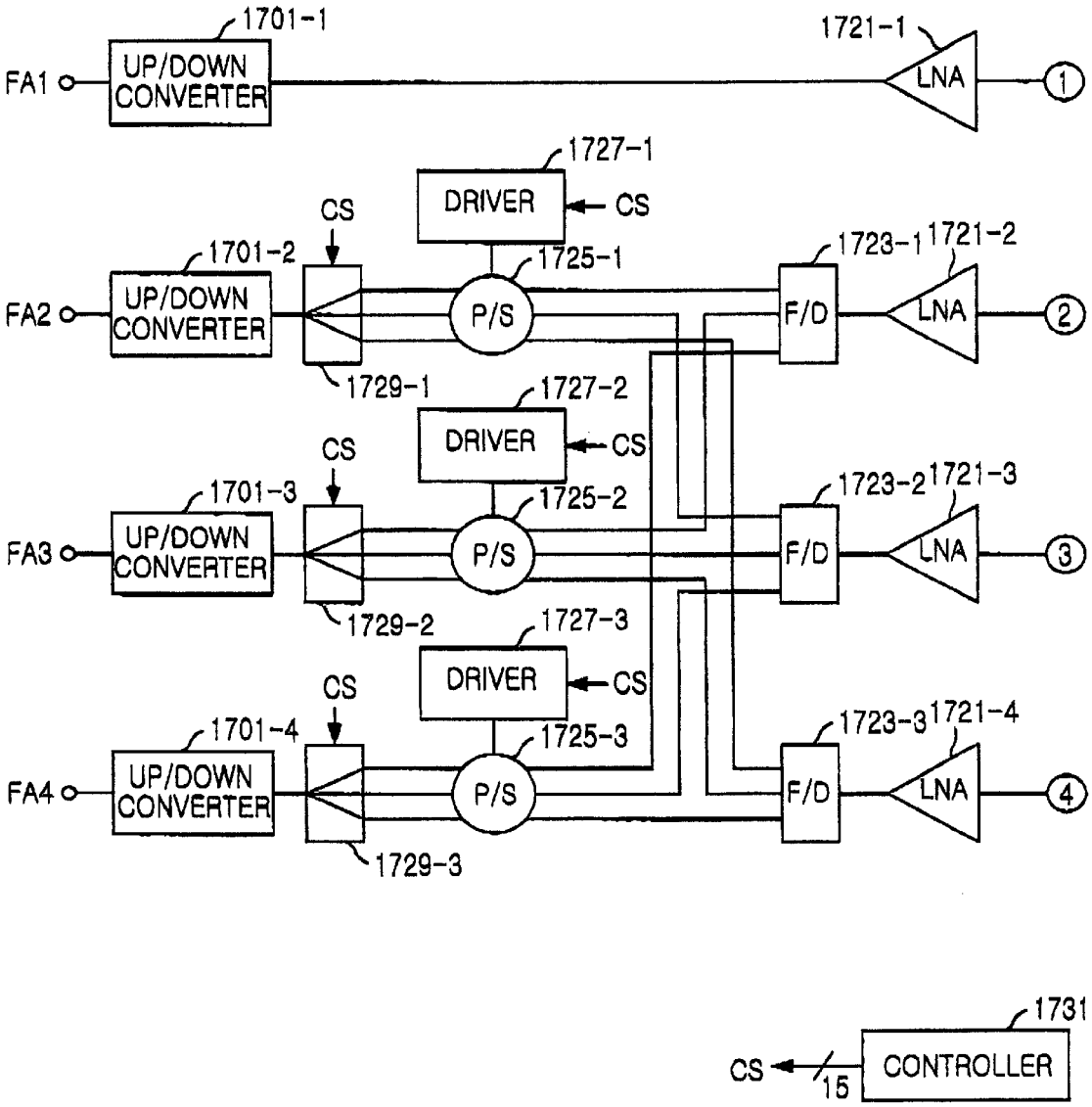
FIGS. 18A and 18B show diagrams of an antenna system when horizontal half-power beam widths are all 30 degrees in accordance with the present invention.
Figure 18B:
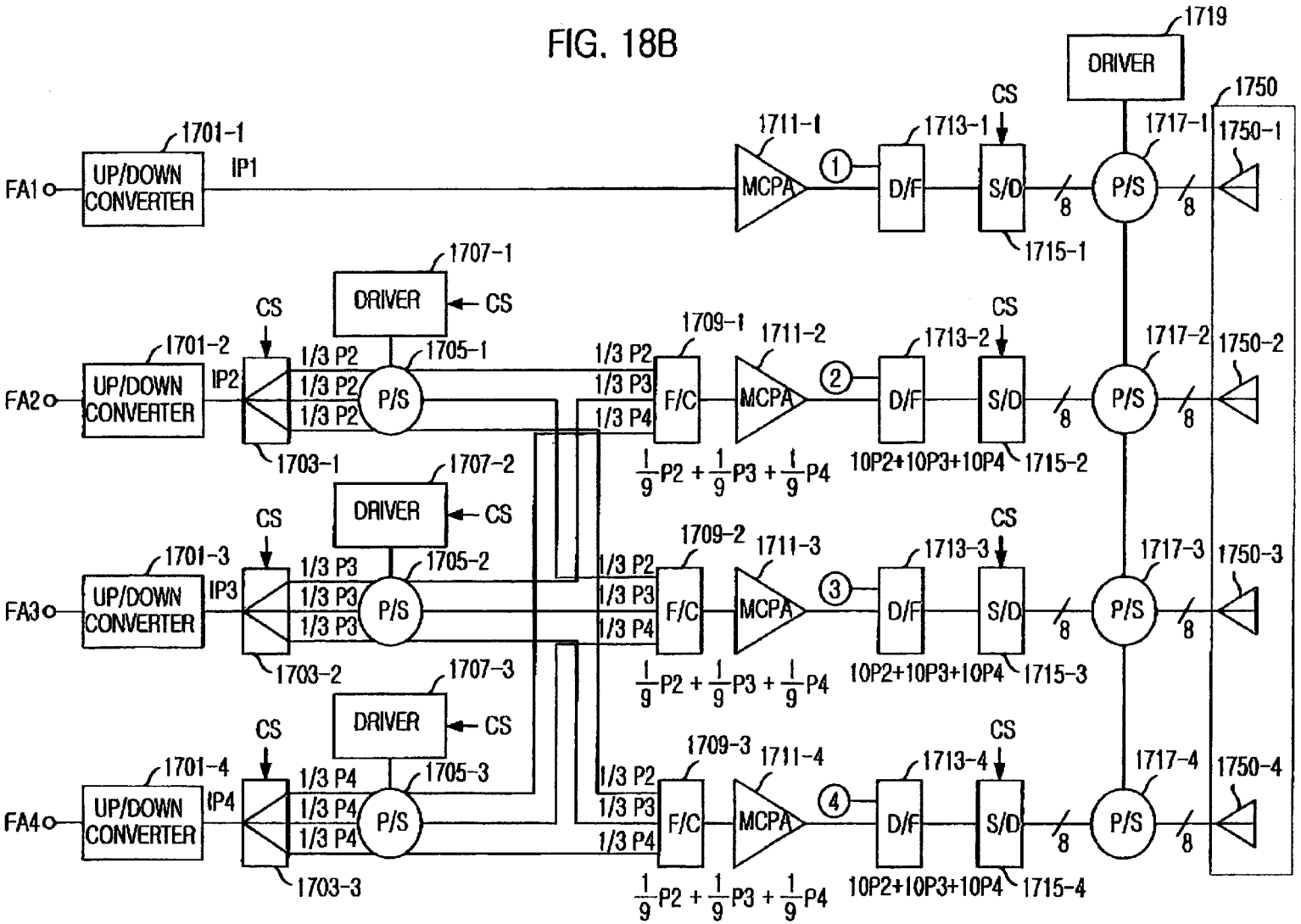

FIGS. 17A and 17B show a base transceiver station (BTS) having a multi-beam controllable antenna system in accordance with the present invention.

The BTS includes an antenna array 1750, up/down converters 1701-1 to 1701-4, horizontal half-power beam width controlling switchable dividers 1703-1 to 1703-3, horizontal tilting angle controlling phase shifters 1705-1 to 1705-3, phase shifter drivers 1707-1 to 1707-3, fixed combiners 1709-1 to 1709-3, multi channel power amplifiers (MCPA) 1711-1 to 1711-4, duplex filters 1713-1 to 1713-4, switchable dividers 1715-1 to 1715-4, phase shifters 1717-1 to 1717-4 for controlling the vertical tilting angles, a phase shifter 1719, low noise amplifiers 1721-1 to 1721-4, fixed dividers 1723-1 to 1723-3, phase shifters 1725-1 to 1725-3, phase shift driver 1727-1 to 1727-3, switchable combiners 1729-1 to 1729-3 and a controller 1731.

Each of he up/down converters 1701-1 to 1701-4 receives signals to be transmitted or received, and up/down converting frequencies of the signals.

Each of the horizontal half-power beam width controlling switchable dividers switchable dividers (S/D) 1703-1 to 1703-3 receives an up-converted signal from the up/down converter 1701-1 to 1701-4 and divides the up-converted signal into a predetermined number of divided signals.

Each of the phase shifters 1705-1 to 1705-3 shifts phases of the divided signals based on a first control signal from a phase shift driver 1707-1, 1707-2 or 1707-3, so that horizontal half-power beam widths of the signal to be transmitted are controlled.

Each of the fixed combiners 1709-1 to 1709-3 receives and combines the divided signals from the phase shifters.

Each of the multi channel power amplifiers (MCPA) 1711-1 to 1711-4 amplifies the signal from the up/down converter or the fixed combiner and outputs a channel-amplified signal.

Each of the duplex filters 1713-1 to 1713-4 performs filtering of the channel-amplified signal from the MCPA and provides a first filtered signal to the antenna array, or performs filtering of the received signal from the antenna array and provides a second filtered signal to the low noise amplifiers.

Each of the switchable dividers 1715-1 to 1715-4 divides the signal outputted from the duplex filter 1713-1 to 1713-4 into eight signals in order to control vertical half-power beam width of the signal to be transmitted.

Each of the phase shifters 1717-1 to 1717-4 shifts phases of the signals from the switchable divider 1715-1 to 1715-4 and generates phase-shifted signals in order to control vertical tilting angle of the signal to be transmitted.

The phase shift driver 1719 generates a control signal to control the phase shifters simultaneously.

The phase-shifted signals are radiated through the antenna array 1750.

Signals received by the antenna array 1750 are filtered by the duplex filters 1713-1 to 1713-4 and amplified by the low noise amplifiers 1721-1 to 1721-4.

Each of the fixed dividers 1723-1 to 1725-3 divides the low noise-amplified signals into three divided signals.

Each of the phase shifter 1725-1 to 1725-3 shifts receives the divided signals one by one and shifts phases of the divided signal, to thereby control horizontal tilting angle of the received signal.

The phase shift drivers 1727-1 to 1727-3 control the phase shifters independently.

Each of the switchable combiner receives signals from the phase shifter and combines a signal in order to control horizontal half-power beam width.

The controller 1731 controls the phase shift drivers, the switchable dividers and the switchable combiners.

The number of sectors included in a cell or the number of the frequency assignments in a sector is designed based on terrestrial characteristics of the cell.

In this specification, only for easy description, let assume that the cell is divided into three sectors and four frequency assignments FA1 to FA4 are assigned to the sector. Also, let assume that the first frequency assignment FA1 is a fixed FA of which the vertical tilting angle and the horizontal half-power beam width are fixed, and the second through forth frequency assignments FA2 to FA4 are variable FAs of which the vertical tilting angle and the horizontal half-power beam width are fixed can be varied.

In the embodiment, it is assume that the first to third horizontal half-power beam width control switchable dividers and the first to third horizontal half-power beam width control switchable combiners are all three-way dividers and combiners, and the fixed combiners and the fixed dividers are all three-way combiners and dividers.

The horizontal tilting angle phase shifters are phase shifters having three transmission lines.

The first to forth vertical half-power beam width control switchable dividers eight-way dividers, the first to the forth vertical tilting angle control phase shifters are phase shifters having eight transmission lines.

Operations and functions of the up/down converters, fixed combiners, the duplex filter, the low noise amplifier (LNA) and fixed divider are well known to one skilled in the art, and therefore, detailed description will be skipped in this specification.

The frequency assignment FA1 outputted from the first up/down converter 1701-1 is provided to the first multi channel power amplifier (MCPA). The others, FA2 to FA4 outputted from the second to forth up/down converters 1701-2 to 1701-4 is divided into three signals by the horizontal half-power beam width control switchable dividers 1703-1 to 1703-3.

The first to third horizontal tilting angle control phase shifters 1705-1 to 1705-3 are controlled by the first to third phase shift drivers 1707-1 to 1707-3 respectively.

The first to third fixed combiners 1709-1 to 1709-3 receives and combines one of the divided signals from the phase shifters 1705-1 to 1705-3.

Each of the multi channel power amplifiers (MCPA) 1711-1 to 1711-3 amplifies the signal from the fixed combiner and outputs a channel-amplified signal.

The first duplex filter 1713-1 receives the signal from the first up/down converter through the first MCPA 1711-1. The second to forth duplex filters 1713-2 to 1713-4 receive the signals from the second to forth MCPA 1711-2 to 1711-4. The duplex filters 1713-1 to 1713-4 perform filtering of the signals from the MCPA 1711-1 to 1711-4 and generates filtered signals.

Each of the vertical half-power beam width control switchable divider 1715-1 to 1715-4 receives and divides the filtered signals into eight divided signals.

Each of the vertical tilting angle control phase shifters 1717-1 to 1717-4 controls phases of the divided signals at the same rate and provides the phase-controlled signals to the antenna array.

The vertical tilting angle control phase shifters 1717-1 to 1717-4 are simultaneously controlled by the phase shift driver 1719 at the same rate.

The received signals are received by the antenna array 60 and inputted to the duplex filters 1713-1 to 1713-4 through the vertical tilting angle control phase shifters 1717-1 to 1717-4 and the vertical half-power beam width control switchable dividers 1715-1 to 1715-4.

The duplex filters 1713-1 to 1713-4 perform filtering of the received signal from the vertical half-power beam width control switchable dividers 1715-1 to 1715-4 and provides a second filtered signal to the low noise amplifiers 1721-1 to 1721-4.

Each of the fixed dividers 1723-1 to 1723-3 divides the low noise-amplified signals into three divided signals.

The three divided signals from the fixed dividers 1723-1 to 1723-3 are received one by one at the horizontal tilting angle controlling phase shifters 1725-1 to 1725-3 and the phases of the divided signal are shifted.

The phase-shifted signals are combined by the horizontal half-power beam width controlling switchable combiners 1729-1 to 1729-3.

The combined signals by the horizontal half-power beam width controlling switchable combiners 1729-1 to 1729-3 are down-converted by the up/down converters 1701-1 to 1701-4 and transmitted to the mobile switching center (MSC) (not shown) through the base station controller (BSC)(not shown).

Hereinafter, a procedure of controlling the horizontal half-power beam width of a corresponding frequency assignment by the horizontal half-power beam width controlling switchable divider will be in detail with reference to FIGS. 17A and 17B.

It is assume that In case of three-way divider being used for the horizontal half-power beam width controlling switchable divider 1703-1 to 1703-3, the horizontal half-power beam widths of the FA2, FA3 and FA4 are 30 degrees. In case of two-way, the horizontal half-power beam widths of the FA2, FA3 and FA4 are 60 degrees, and in case of one-way, those of the FA2, FA3 and FA4 are 90 degrees.

The FA1 can be used as a variable FA by connecting the horizontal half-power beam width controlling switchable divider, the horizontal tilting angle controlling phase shifter and the fixed combiners. In this case, four-way switchable divider and four transmission lines should be used, and therefore, the horizontal half-power beam width of each FA can be varied between 120 and 0 degree.

According to the number of ways of the divider, the horizontal half-power beam width of the FA can be varied and is not limited to a certain angle.

For example, if the horizontal half-power beam width controlling switchable divider 1703-1 is a four-way divider, the FA signals are radiated through the horizontal tilting angle controlling phase shifter 1705-1, the vertical half-power beam width controlling switchable divider 1715-1 to 1715-4, the vertical tilting angle controlling phase shifter 1717-1 to 1717-4 and the radiators 1705-1 to 1705-4 of the antenna array. In other words, the FA signals are radiated through four array antennas.

However, if the horizontal half-power beam width controlling switchable divider 1703-1 is a three-way, two-way or one-way divider, the FA signals are radiated through three, two, or one array antenna(s).

The variation in the number of the antenna array means that the horizontal half-power beam width of the FA signal is varied. If horizontal half-power beam width of the FA signal can be varied, local traffic increase can be solved.

In the horizontal tilting angle controlling phase shifter 1705-1, arc transmission lines are symmetrically formed. At driving the phase shift, the phases of the transmission lines are symmetrically varied with the same rate. In other words, since the phases of the signals fed to the radiators 1750-1 to 1750-4 of the antenna array are symmetrically varied with the same rate, the FA signals can be horizontally tilted.

As mentioned above, if the FA signals can be horizontally tilted, an antenna beam can be radiated to a wanted area, and therefore, the antenna can be established freely and it can be dealt with a local traffic increase.

A method for controlling the vertical half-power beam width is similar to the method for controlling the horizontal half-power beam width as mentioned above. In other words, if the vertical half-power beam width controlling switchable divider 1715-1 operates as the eight-way divider, the FA signals are radiated through eight antenna arrays, if does as the seven-way to one-way divider, the FA signals are radiated through seven antenna arrays to one antenna array.

The variation in the number of the antenna array means that the vertical half-power beam width of the FA signal is varied.

At driving the vertical half-power beam width controlling phase shifter 1717-1, the phases of the transmission lines are symmetrically varied with the same rate. In other words, since the phases of the signals fed to the eight antenna arrays are symmetrically varied with the same rate, the FA signals can be vertical tilted.

As mentioned above, if the FA signals can be vertically tilted, an identical channel interference signal from another BTS using the same frequency can be decreased.

At this time, only if the vertical half-power beam width controlling phase shifters 1717-1 to 1717-4 are simultaneously controlled with the same rate, an adjust vertical tilting can be performed.

Hereinafter, the horizontal and the vertical tilting will be described with reference to intensities of the FA2, FA3 and FA4.

In case of the three-way divider, there are ten possible cases of the horizontal half-power beam width in each FA, for only easy description, one case will be described that all of the dividers operate as the three-way divider and the horizontal half-power beam width of the FA is 30 degree.

Referring to FIGS. 17A and 17B, if the intensities of the FA2, FA3 and FA4 inputted to the horizontal half-power beam width controlling switchable dividers 1703-1 to 1703-3 are denoted by 1P2, 1P3 and 1P4, 1P2 signal is divided into three 1/3P2 signals.

The 1P3 signal is divided into three 1/3P3 signals by the second horizontal half-power beam width controlling switchable divider 1703-2 and the 1P4 signal is divided into three 1/3P4 signals by the third horizontal half-power beam width controlling switchable divider 1703-3.

The signals divided by the first to third horizontal half-power beam width controlling switchable dividers 1703-1 to 1703-3 are phase-shifted by the first to third horizontal tilting angle controlling phase shifters 1705-1 to 1705-3 and then applied to the first to third fixed combiners 1709-1 to 1709-3 respectively.

In other words, 1/3P2, 1/3P3 and 1/3P4 signals are inputted to the first to second fixed combiners 1709-1 to 1709-3 and combined respectively. The combined signals by the first to third fixed combiners 1709-1 to 1709-3 become 1/9P2+1/9P3+1/9P4.

When the number of signals inputted to the first to third fixed combiners 1709-1 to 1709-3 is varied, in order not to vary the characteristics of the radio frequency, a first to a third matching circuits can be added. The matching circuit can be an isolator or a switch of which 50Ω resistor is grounded.

If the MCPA is an amplifier amplifying the signal 90 times, output signals of the first to third MCPA become 10P2+10P3+10P4.

In more detail description, while the intensity of the amplified signal is 30P, 10P2+10P3+10P4 signals are included in 30P. In other words, 10P2+10P3+10P4 signals are radiated through three antenna arrays.

Figure 19:
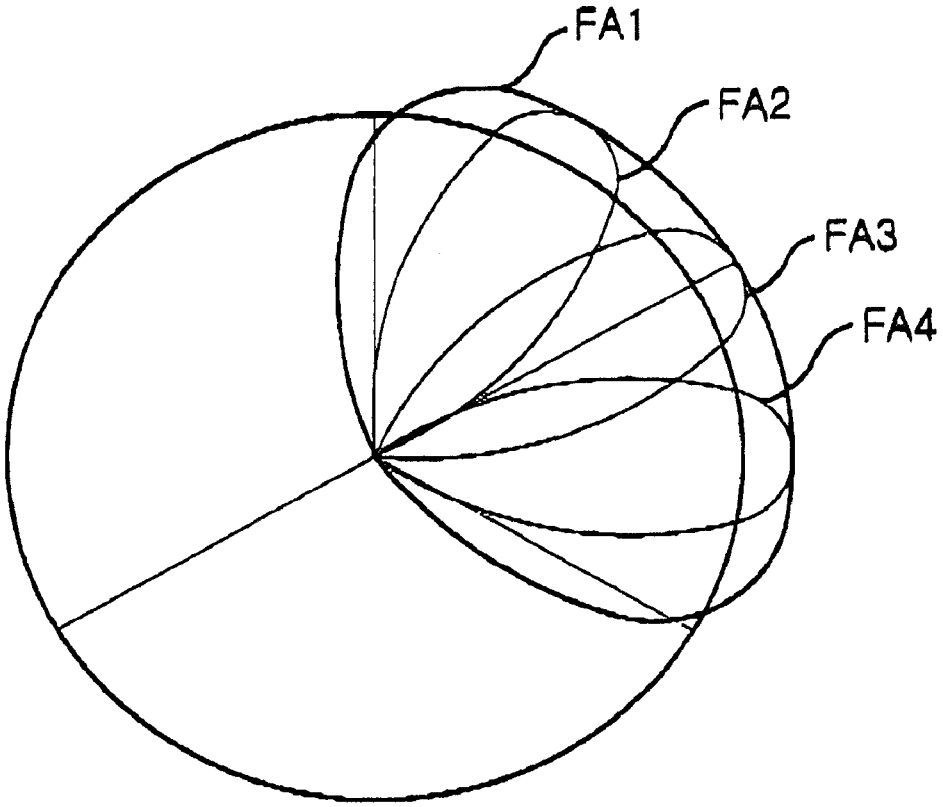
FIG. 19 depicts the horizontal half-power beam widths of the FAs emitted from the antenna system of FIGS. 18A and 18B.
Figure 20A:
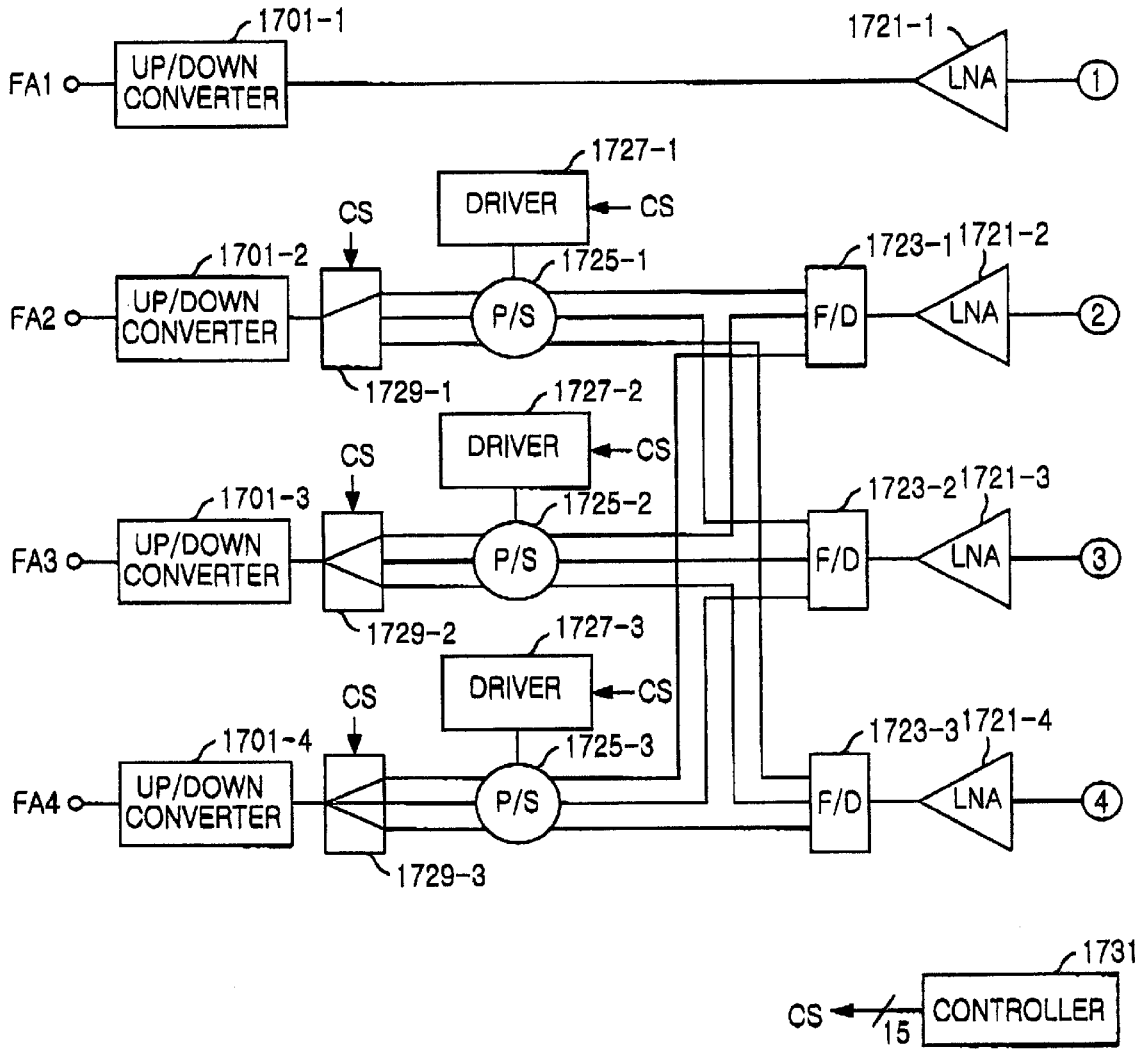
FIGS. 20A and 20B diagrams of an antenna system when horizontal half-power beam widths are 90, 60 and 30 degrees in accordance with the present invention.
Figure 20B:
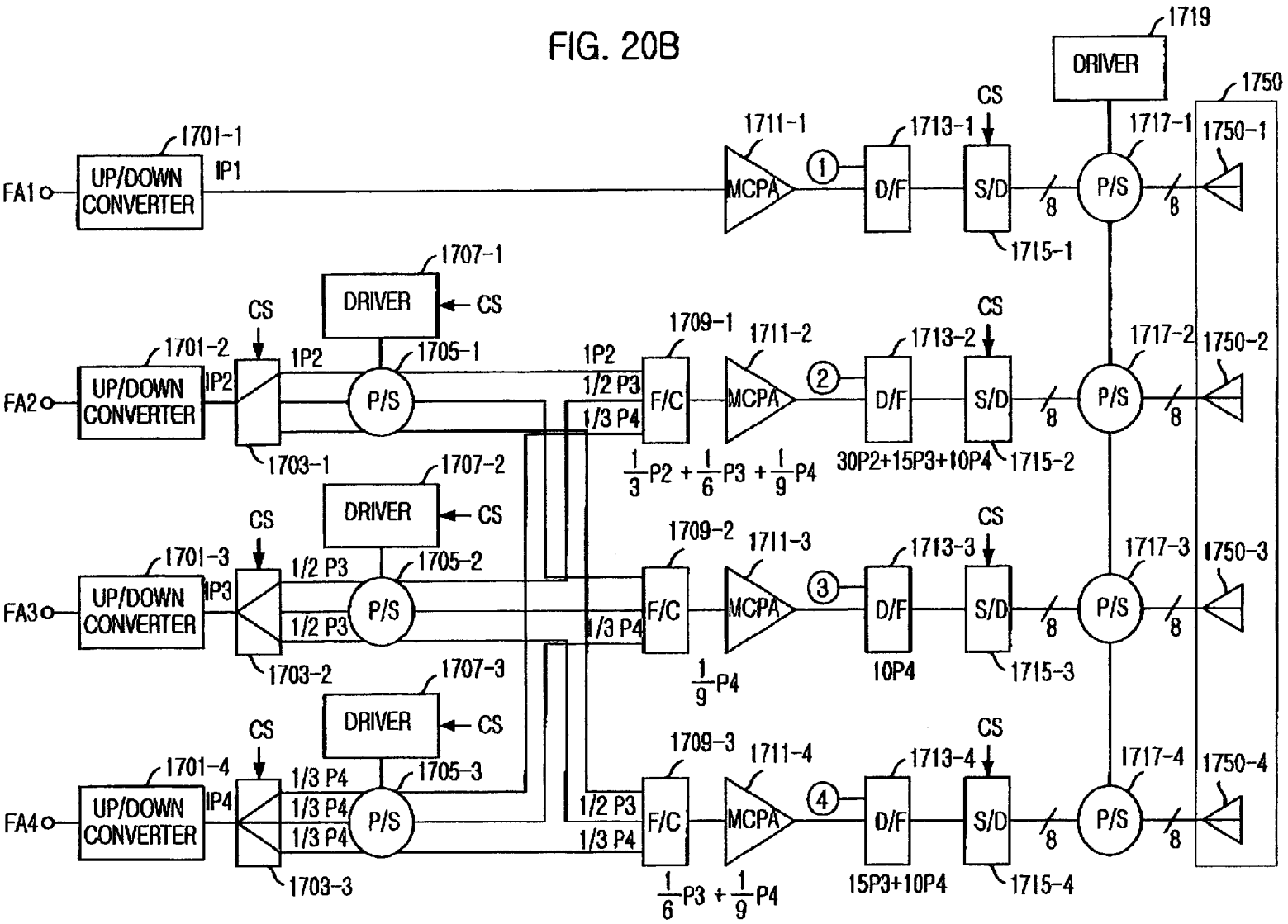

At this time, the horizontal half-power beam width of the FA1 is 120 degree, and those of the FA2 to FA4 are 30 degrees. By horizontally tilting the FA2, FA3 and FA4 through the horizontal tilting angle controlling phase shifters 1705-1 to 1705-3, if the FA2, FA3 and FA4 are arranged within the sector having 120 degrees, which is illustrated in FIG. 19.

For another example, it will be described that the first horizontal half-power beam width controlling divider 1703-1 operates as one-way divider, the second horizontal half-power beam width controlling divider 1703-2 does as two-way divider and the third horizontal half-power beam width controlling divider 1703-3 does as three-way divider.

In other words, a case that the horizontal half-power beam width of the FA2 is 90 degrees, the horizontal half-power beam width of the FA3 is 60 degrees and the horizontal half-power beam width of the FA4 is 30 degrees will be described.

The FA2 signal amplified by the second up/down converter 11 is applied to the first fixed combiner 1709-1 through the first horizontal half-power beam width controlling switchable divider 1703-1 and the first horizontal tilting angle controlling phase shifter 1705-1.

The FA3 signal amplified by the third up/down converter 1701-3 is divided into two signals by the second horizontal half-power beam width controlling switchable divider 1703-2 and applied to the first and the third fixed combiners 1709-1 and 1709-3 through the second horizontal tilting angle controlling phase shifter 1705-2.

The FA4 signal amplified by the forth up/down converter 1701-4 is divided into three signals by the second horizontal half-power beam width controlling switchable divider 1703-3 and applied to the first to the third fixed combiners 1709-1 to 1709-3 through the third horizontal tilting angle controlling phase shifter 1705-3.

The first fixed combiner 1709-1 receives 1P2, 1/2P3 and 1/3P4 signals, the second fixed combiner 24 1/3P4 and the third fixed combiner 1709-3 1/2P3 and 1/3P4 signals.

The signal combined by the first fixed combiner 1709-1 is 1/3P2+1/6P3+1/9P4 which is amplified by the first MCPA 1711-2 and then becomes 30P2+15P3+10P4.

The signal combined by the second fixed combiner 24 is 1/9P4 which is amplified by the second MCPA 1711-2 and then becomes 10P4.

The signal combined by the third fixed combiner 1709-3 is 1/6P3+1/9P4 which is amplified by the third MCPA 1711-3 and then becomes 15P3+10P4.

At this time, although output power levels of the first, second and third MCPA 1711-2 to 1711-3 are different, i.e., 55P, 10P, 35P, each output power level of the FA2, FA3 and FA4 is the same as 30P.

Figure 23A:
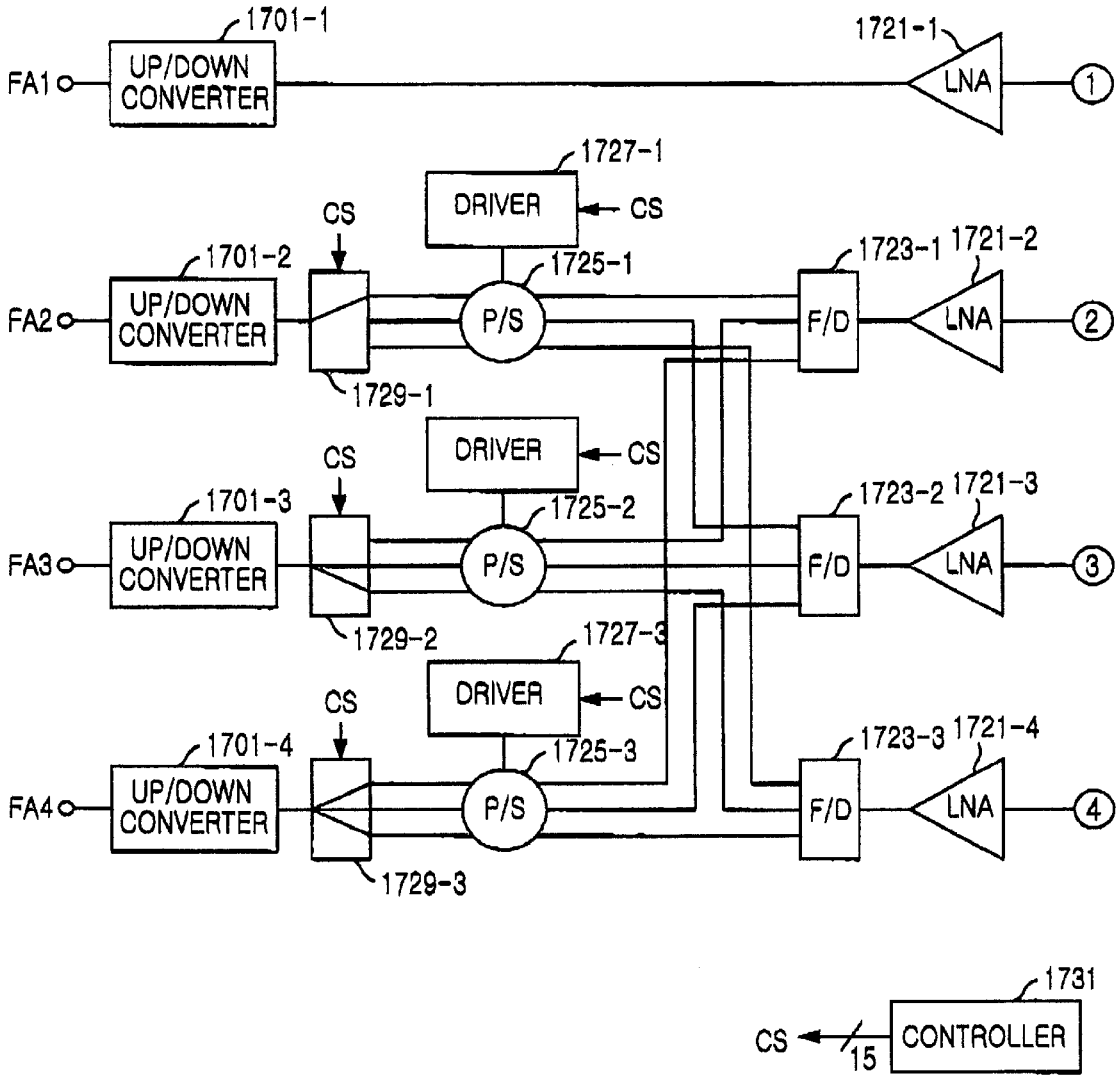
FIGS. 23A and 23B are diagrams of an antenna system when horizontal half-power beam widths are 90, 60 and 30 degrees and output signals of a second horizontal half-power beam width controlling switchable divider are controlled so as to be inputted to a second and a third fixed combiners.
Figure 23B:
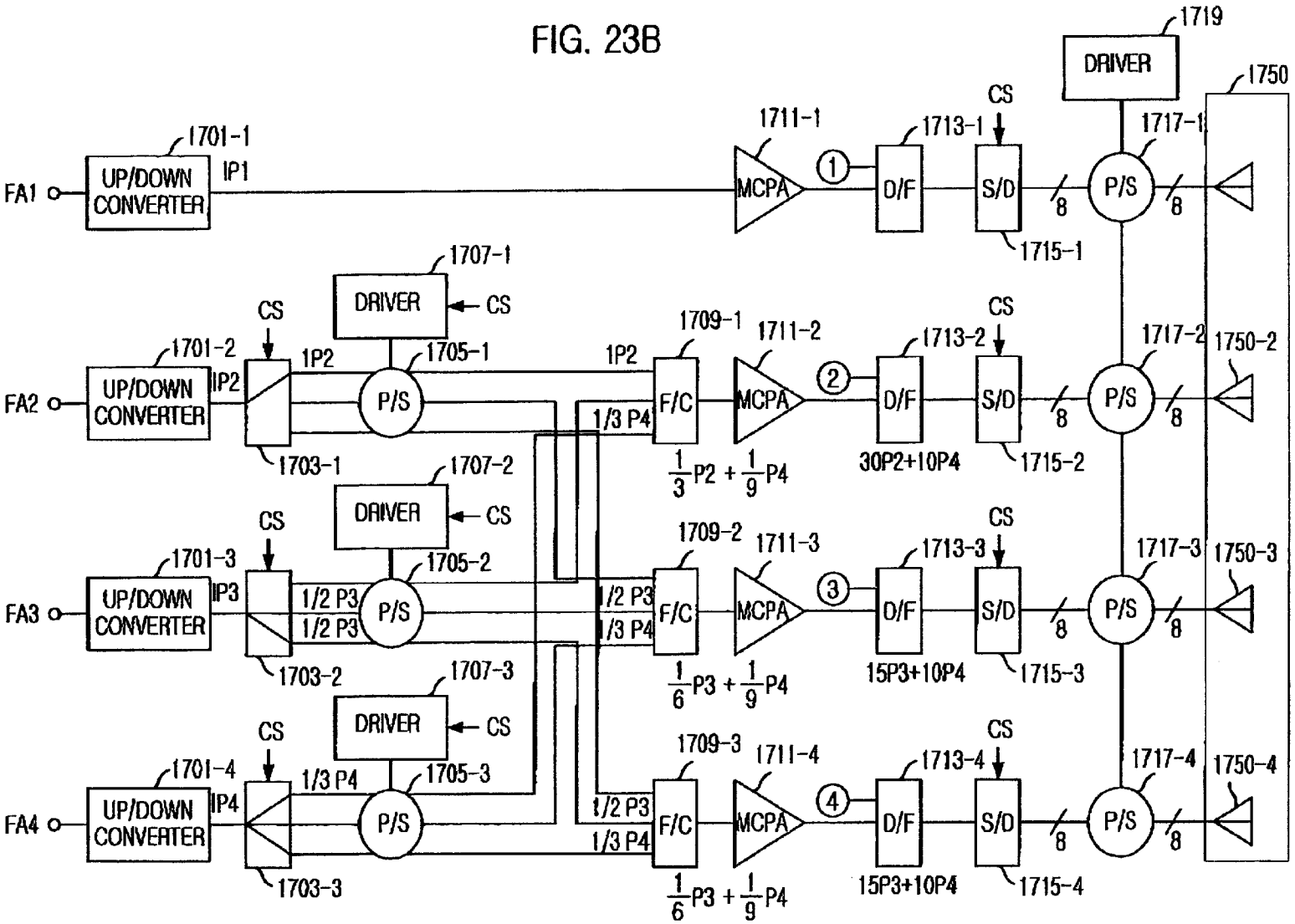

Since the output power level of the first MCPA 1711-1 is 55P, in order to prevent one of the output power levels of the MCPA from being larger than a predetermined value, as shown in FIGS. 23A and 233, the signal outputted from the second horizontal half-power beam width controlling switchable divider 15 can be applied to the second and third fixed combiners 1709-2 and 1709-3.

If the signal outputted from the second horizontal half-power beam width controlling switchable divider 1703-2 can be applied to the second and third fixed combiners 1709-2 and 1709-3, the input signals of the first fixed combiner 1709-1 are 1P2 and 1/3P4, those of the second fixed combiner 1709-2 are 1/2P3 and 1/3P4, and those of the third fixed combiner 1709-3 are 1/2P3 and 1/3P4.

The signal combined by the first fixed combiner 1709-1 is 1/3P2+1/9P4 which is amplified by the first MCPA 1711-1 and then becomes 30P2+10P4.

The signal combined by the second fixed combiner 1709-2 is 1/6P2+1/9P4 which is amplified by the second MCPA 1711-3 and then becomes 15P2+10P4.

The signal combined by the third fixed combiner 1709-3 is 1/6P3+1/9P4 which is amplified by the third MCPA 1711-3 and then becomes 15P3+10P4.

In other words, the output power level of the first MCPA 1711-1 is 40P, that of the second MCPA 1711-2 is 25P, and that of the third MCPA 1711-3 is 25P, such that capacity of the amplifier can be reduced.

Figure 21:
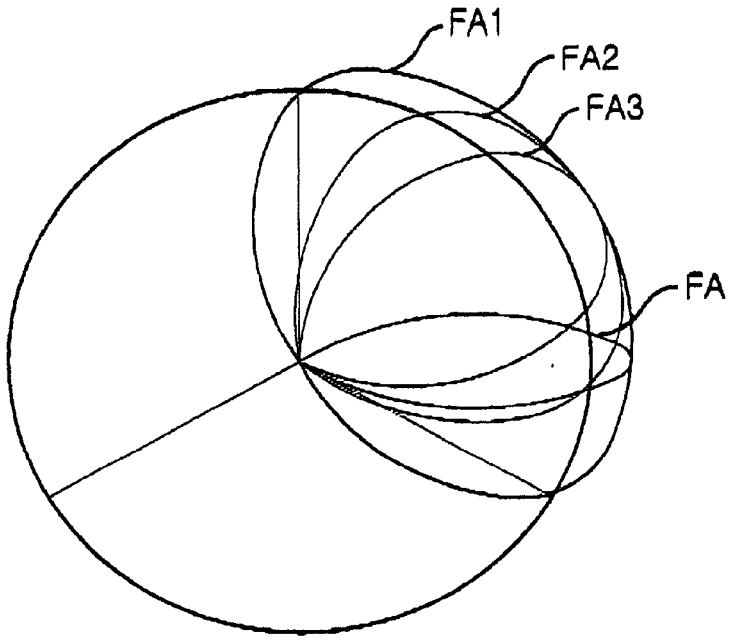
FIG. 21 depicts the horizontal half-power beam widths of the FAs emitted from the antenna system of FIGS. 20A and 20B.

At this time, by horizontally tilting the FA2, FA3 and FA4 through the horizontal tilting angle controlling phase shifters 1705-1 to 1705-3, if the FA2, FA3 and FA4 are arranged within the sector having 120 degrees, which is illustrated in FIG. 21.

Figure 22:
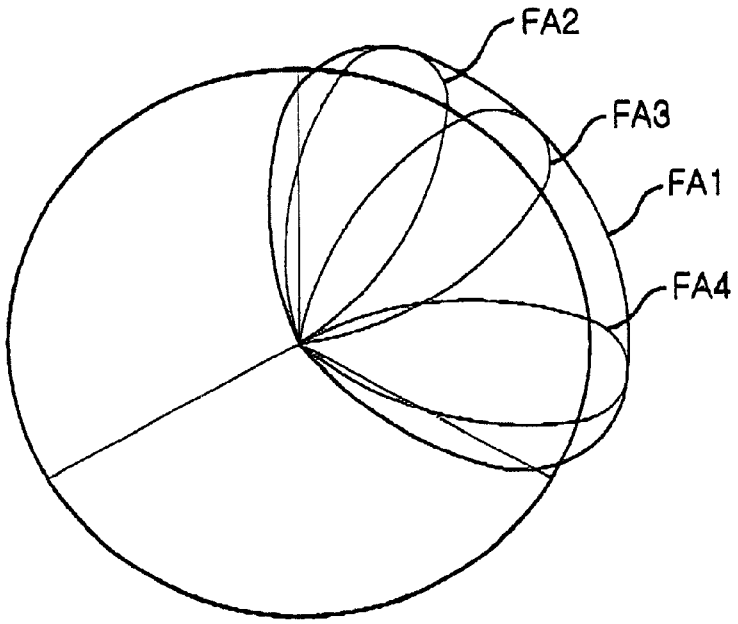
FIG. 22 depicts the horizontal half-power beam widths of the FAs emitted from the antenna system when the horizontal half-power beam widths and the vertical tilting angles of the FA2, FA3 and FA4 are controlled so as to deal with the traffic increase in a certain area within a sector.

When the traffic is temporarily increased in a certain area of the sector, by controlling the horizontal half-power beam width controlling switchable dividers 1703-1 to 1703-3 and the vertical tilting angle controlling phase shifters 1705-1 to 1705-3, as showing in FIG. 22, the FA2 and FA3 can be focused to the certain area of which the traffic is increased. Therefore, the quality of the communication can be kept in that area.

For example, when the first to third horizontal half-power controlling switchable dividers 1703-1 to 1703-3 operate as one-way divider, if the traffic is temporarily increased in a certain area of one of three sectors, it is increased the number of ways of the horizontal half-power controlling switchable dividers 1703-1 to 1703-3 dividing the FA2 to FA4 signals so as to decrease the half-power beam width, and the beams of the FA2 to FA4 are controlled to be horizontally tilted to the certain area by controlling the horizontal tilting angle controlling phase shifters 1705-1 to 1705-3.

In order to deal with a local traffic increase, the sector is divided smaller, which can increase the capacity of the call processing without dividing the sector.

In this specification, the switchable divider and the fixed combiner can be used as the switchable combiner and the fixed divider, only if the input and the output ports of them are changed.

The first to third horizontal half-power beam width controlling switchable combiners 1729-1 to 1729-3, the forth to sixth horizontal tilting angle controlling phase shifters 1725-1 to 1725-3, the first to third fixed dividers 1723-1 to 1723-3, the first to third horizontal half-power beam width controlling switchable dividers 1703-1 to 1703-3, the first to third horizontal tilting angle controlling phase shifters 1705-1 to 1705-3 and the first to third fixed combiners have the same connection.

Switching and phase-shifting of the first to third horizontal half-power beam width controlling switchable combiners 1729-1 to 1729-3, the forth to sixth horizontal tilting angle controlling phase shifters 1725-1 to 1725-3, the first to third horizontal half-power beam width controlling switchable dividers 1703-1 to 1703-3, the first to third horizontal tilting angle controlling phase shifters 1705-1 to 1705-3 can be controlled based on the same control signal or independent control signals.

If the switching and phase-shifting are controlled based the same control signal, transmission and reception service areas which are covered by the vertical/horizontal half-power beam width and the tilting angle are identical.

On the contrary, if the switching and phase-shifting are controlled based the independent control signal, transmission and reception service areas are different from each other.

The switchable divider, the switchable combiner and the phase shift driver are controlled by the controller 1731 which receives necessary control data from the BSC and the MSC.

Figure 24:
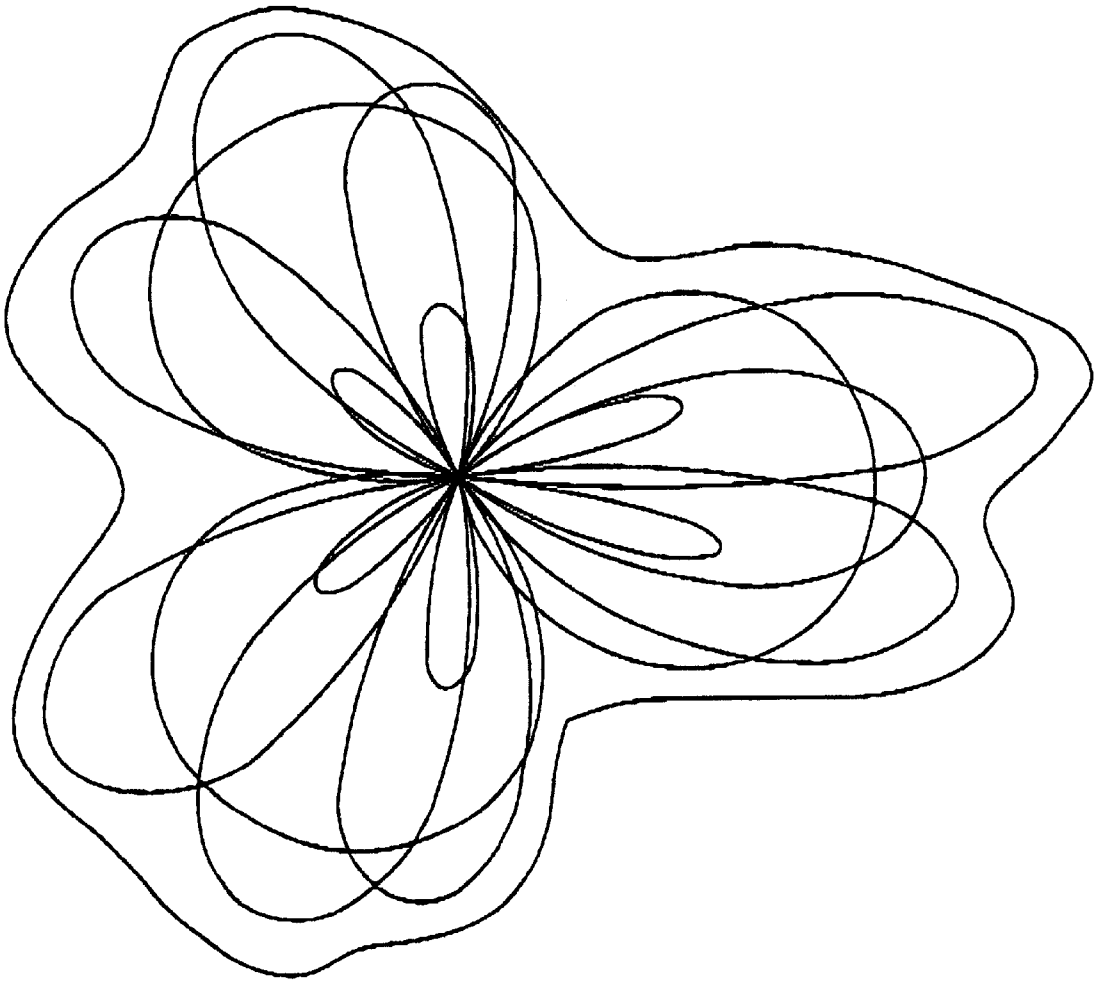
FIG. 24 shows the horizontal half-power beam widths of the FAs emitted from the antenna system when the horizontal half-power beam widths and the vertical tilting angles are controlled independently.

FIG. 24 shows the horizontal half-power beam widths of the FAs emitted from the antenna system when the horizontal half-power beam widths and the vertical tilting angles are controlled independently.

When the horizontal half-power beam widths and the vertical tilting angles can be varied freely, the beam patterns of the FAs can be illustrated as shown in FIG. 24.

When using the multi beam controllable antenna system and the BTS having the same, the vertical/horizontal half-power beam width and tilting angle are automatically controlled based on the variation in the number of the subscribers and an amount of the traffic within the sector, to thereby decrease the identical channel interference signal from another BTS using the same frequency. The beam of the FA signal can be accurately steered, to thereby establish the antenna system easily.

When using the multi beam controllable antenna system, since optimal design in cell service area and division of the sectors can be performed in irregular microwave environments, the antenna system can be established on a various location, for example, the wall of the building, tower, etc.

Each FA can be assigned to a certain area within the sector, and therefore, the traffic increase of the local area can be appropriately dealt with, and the overlapped area between the FAs can be reduced.

Since the devices located in the conventional BTS are located in the antenna system, the transmission losses can be reduced. Therefore, a low capacity MCPA can be used, which it costs low, size of the BTS can reduced and limited radio resources can be effectively used.

While the present invention has been described with respect to the particular embodiments, it will be apparent to those skilled in the art that various changes and modifications may be made without departing from the scope of the invention as defined in the following claims.

What is claimed is:

1. An antenna system for controlling multi beams of a transmission signal, comprising:

at least one first divider that divides an input signal into a plurality of first divided signals;

at least one first phase shifter that shifts the first divided signals and generates first phase-shifted signals;

at least one first combiner that combines the first phase-shifted signals and generates a first combined signal;

at least one second divider that divides the first combined signal into a plurality of second divided signals;

at least one second phase shifter that shifts the second divided signals and generates second phase-shifted signals; and a controller that generates a control signal which controls horizontal and vertical half-power beam widths and tilting angles of the input signal independently by controlling the first divider and the second divider and the first phase shifter and the second phase shifter.

2. The antenna system as recited in claim 1, further comprising:

an antenna array having a plurality of radiating devices.

3. The antenna system as recited in claim 2, further comprising:

at least one amplifier that amplifies the first combined signal, generates an amplified signal and provides the amplified signal to the second divider.

4. The antenna system as recited in claim 1, wherein a number of the first divided signals is settable based on a variable range of the horizontal half-power beam width of the input signal.

5. The antenna system as recited in claim 1, wherein a number of the first divided signals is set based on a number of radiation devices.

6. The antenna system as recited in claim 1, wherein the first phase shifter and the second phase shifter can simultaneously control a phase of the input signal at a predetermined rate.

7. The antenna system as recited in claim 1, wherein a number of the second divided signals is settable based on a variable range of the vertical half-power beam width of the input signal.

8. The antenna system as recited in claim 1, wherein a number of the second divided signals is set based on a number of radiation devices.

9. The antenna system as recited in claim 1, further comprising:

at least one third divider that divides a signal received by an antenna array into a plurality of third divided signals;

at least one third phase shifter that controls phases of the third divided signals and generates third phase-shifted signals; and at least one second combiner that combines the third phase-shifted signals, generates a second combined signal and outputs the second combined signal.

10. The antenna system as recited in claim 9, wherein a number of the third divided signals is set based on a number of radiation devices.

11. An antenna system for receiving a signal, comprising:

at least one first phase shifter that shifts input signals received by an antenna array and that generates first phase-shifted signals;

at least one first divider that divides the first phase-shifted signals into a plurality of first divided signals;

at least one second divider that divides the first divided signals and generates second divided signals;

at least one second phase shifter that shifts the second divided signals and generates second phase-shifted signals;

at least one first combiner that combines the second phase-shifted signals and generates a first combined signal; and a controller that generates a control signal which controls horizontal and vertical half-power beam widths and tilting angles of the input signals independently by controlling the first divider and second divider and the first phase shifter and second phase shifter.

12. The antenna system as recited in claim 11, wherein a number of the first combined signals is settable based on a variable range of the horizontal half-power beam width of the signal.

13. The antenna system as recited in claim 11, wherein a number of the first divided signals is set based on a number of radiation devices.

14. The antenna system as recited in claim 11, wherein the first phase shifter and second phase shifter control phase of the input signal at a predetermined rate.

15. The antenna system as recited in claim 11, wherein a number of the second divided signals is the same as a number of signals combinable by the first combiner.

16. The antenna system of claim 11, wherein a number of the first divided signals is settable based on variable range of the vertical half-power beam width of the input signal.

17. A base transceiver station for controlling multi beams of a transmission signal, comprising:

at least one first divider that divides an input signal into a plurality of first divided signals;

at least one first phase shifter that shifts the first divided signals and generates first phase-shifted signals;

at least one first combiner that combines the first phase-shifted signals and generates a first combined signal;

at least one second divider that divides the first combined signal into a plurality of second divided signals;

at least one second phase shifter that shifts the second divided signals and generates second phase-shifted signals; and a controller that generates a control signal which controls horizontal and vertical half-power beam widths and tilting angles of the input signal independently by controlling the first divider and the second divider and the first phase shifter and the second phase shifters.

18. The base transceiver station as recited in claim 17, further comprising:

an antenna array having a plurality of radiating devices.

19. The base transceiver station as recited in claim 17, further comprising:

at least one amplifier that amplifies the first combined signal and generates an amplified signal.

20. The base transceiver station as recited in claim 17, wherein a number of the first divided signals is settable based on a variable range of the horizontal half-power beam width of the input signal.

21. The base transceiver station as recited in claim 17, wherein a number of the first divided signals is set based on a number of radiation devices.

22. The base transceiver station as recited in claim 17, wherein the first phase shifter and the second phase shifter can simultaneously control a phase of the input signal at a predetermined rate.

23. The base transceiver station as recited in claim 17, wherein a number of the second divided signals is settable based on a variable range of the vertical half-power beam width of the input signal.

24. The base transceiver station as recited in claim 17, wherein a number of the second divided signals is set based on a number of radiation devices.

25. The base transceiver station as recited in claim 17, further comprising:

at least one third divider that divides a signal received by an antenna array into a plurality of third divided signals;

at least one third phase shifter that controls phases of the third divided signals and generates third phase-shifted signals; and at least one second combiner that combines the third phase-shifted signals generates a second combined signal and outputs the second combined signal.

26. The base transceiver station as recited in claim 25, wherein a number of the third divided signals is set based on a number of radiation devices.

27. A base transceiver station for receiving a signal, comprising:

at least one first phase shifter that shifts a signal received by an antenna array and generates a first phase-shifted signal;

at least one first divider that divides the first phase-shifted signal into a plurality of first divided signals;

at least one second divider that divides the first divided signals into a plurality of second divided signals;

at least one second phase shifter that shifts the second divided signals and generates second phase-shifted signals;

at least one combiner that combines the second phase-shifted signals and generates a first combined signal; and a controller that generates a control signal which controls horizontal and vertical half-power beam widths and tilting angles of the signal independently by controlling the first divider and the second divider and the first phase shifter and second phase shifter.

28. The base transceiver station as recited in claim 27, wherein a number of the first combined signals is settable based on a variable range of the horizontal half-power beam width of the signal.

29. The base transceiver station as recited in claim 27, wherein a number of the first divided signals is set based on a number of radiation devices.

30. The base transceiver station as recited in claim 27, wherein the first phase shifter and second phase shifter can control a phase of the signal at a predetermined rate.

31. The base transceiver station as recited in claim 27, wherein a number of the second divided signals is the same as a number of signals combinable by the first combiner.

32. The base transceiver station as recited in claim 27, wherein a number of the first divided signals is settable based on variable range of the vertical half-power bean width of the input signal.

33. A method for controlling multi beams of a transmission signal in an antenna system, comprising:

a) at a first divider, dividing an input signal into a plurality of first divided signals;

b) at a first phase shifter, shifting the first divided signals and generating first phase-shifted signals;

c) at a first combiner, combining the first phase-shifted signals and generating a first combined signal;

d) at a second divider, dividing the first combined signal into a plurality of second divided signals;

e) at a second phase shifter, shifting the second divided signals and generating second phase-shifted signals; and f) generating a control signal which controls horizontal and vertical half-power beam widths and tilting angles of the input signal independently by controlling the first divider and the second divider and the first phase shifter and the second phase shifter.

34. The method as recited in claim 33, further comprising:

g) radiating the second phase-shifted signals through an antenna array having a plurality of radiating devices.

35. The method as recited in claim 34, further comprising:

h) amplifying the first combined signal, generating an amplified signal and providing the amplified signal to the second divider.

36. The method as recited in claim 33, wherein a number of the first divided signals is settable based on a variable range of the horizontal half-power beam width of the input signal.

37. The method as recited in claim 33, wherein a number of the first divided signals is set based on a number of radiation devices.

38. The method as recited in claim 33, wherein the first phase shifter and the second phase shifter can simultaneously control a phase of the input signal at a predetermined rate.

39. The method as recited in claim 33, wherein a number of the second divided signals is settable based on a variable range of the vertical half-power beam width of the input signal.

40. The method as recited in claim 33, wherein a number of the second divided signals is set based on a number of radiation devices.

41. The method as recited in claim 33, further comprising:

i) at a third divider, dividing a signal received by the antenna array into a plurality of third divided signals;

j) at a third phase shifter, controlling phases of the third divided signals and generating third phase-shifted signals; and k) at a second combiner, combining the third phase-shifted signals, generating a second combined signal and outputting the second combined signal.

42. The method as recited in claim 41, wherein a number of the third divided signals is set based on a number of radiation devices.

43. A method for controlling multi beams of a received signal in an antenna system, comprising:

a) at a first phase shifter, shifting a signal received by an antenna array and generating a first phase-shifted signal;

b) at a first divider, dividing the first phase-shifted signal into a plurality of first divided signals;

c) at a second divider, dividing the first divided signals into a plurality of second divided signals;

d) at a second phase shifter, shifting the second divided signals and generating second phase-shifted signals;

e) at a combiner, combining the second phase-shifted signals and generating a first combined signal; and f) generating a control signal which controls horizontal and vertical half-power beam widths and tilting angles of the signal independently by controlling the first and second divider and the first and second phase shifters.

44. The method as recited in claim 43, wherein a number of the first combined signals is settable based on a variable range of the horizontal half-power beam width of the signal.

45. The method as recited in claim 43, wherein a number of the first divided signals is set based on a number of radiation devices.

46. The method as recited in claim 43, wherein the first phase shifter and second phase shifter can control phase of the signal at a predetermined rate.

47. The method as recited in claim 43, wherein a number of the second divided signals is the same as a number of signals combinable by the first combiner.

48. The method as recited in claim 43, wherein a number of the first divided signals is settable based on variable range of the vertical half-power beam width of the input signal.

49. A method for controlling multi beams of a transmission signal in a base transceiver station, comprising:

a) at a first divider, dividing an input signal into a plurality of first divided signals;

b) at a first phase shifter, shifting the first divided signals and generating first phase-shifted signals;

c) at a first combiner, combining the first phase-shifted signals and generating a first combined signal;

d) at a second divider, dividing the first combined signal into a plurality of second divided signals;

e) at a second phase shifter, shifting the second divided signals and generating second phase-shifted signals; and f) generating a control signal which controls horizontal and vertical half-power beam widths and tilting angles of the input signal independently by controlling the first divider and the second divider and the first phase shifter and the second phase shifter.

50. The method as recited in claim 49, further comprising:

radiating the second phase-shifted signals through an antenna array having a plurality of radiating devices.

51. The method as recited in claim 50, further comprising:

amplifying the first combined signal, generating an amplified signal and providing the amplified signal to the second divider.

52. The method as recited in claim 49, wherein a number of the first divided signals is settable based on a variable range of the horizontal half-power beam width of the input signal.

53. The method as recited in claim 49, wherein a number of the first divided signals is set based on a number of radiation devices.

54. The method as recited in claim 49, wherein the first phase shifter and the second phase shifter can simultaneously control a phase of the input signal at a predetermined rate simultaneously.

55. The method as recited in claim 49, wherein a number of the second divided signals is settable based on a variable range of the vertical half-power beam width of the input signal.

56. The method as recited in claim 49, wherein a number of the second divided signals is set based on a number of radiation devices.

57. The method as recited in claim 49, further comprising:

at a third divider, dividing a signal received by an antenna array into a plurality of third divided signals;

at a third phase shifter, controlling phases of the third divided signals and generating third phase-shifted signals; and at a second combiner, combining the third phase-shifted signals and generating a second combined signal and outputting the second combined signal.

58. The method as recited in claim 57, wherein a number of the third divided signals is set based on a number of radiation devices.

59. A method for controlling multi beams of a received signal in a base transceiver station, comprising:

a) at a first phase shifter, shifting a signal received by an antenna array and generating a first phase-shifted signal;

b) at a first divider, dividing the first phase-shifted signal into a plurality of first divided signals;

c) at a second divider, dividing the first divided signals into a plurality of second divided signals;

d) at a second phase shifter, shifting the second divided signals and generating second phase-shifted signals;

e) at a first combiner, combining the second phase-shifted signals and generating a first combined signal; and f) generating a control signal which controls horizontal and vertical half-power beam widths and tilting angles of the input signal independently by controlling the first divider and second divider and the first phase shifter and second phase shifter.

60. The method as recited in claim 59, wherein a number of the first combined signal is settable based on a variable range of the horizontal half-power beam width of the signal.

61. The method as recited in claim 60, wherein a number of the first divided signals is set based on a number of radiation devices.

62. The method as recited in claim 60, wherein the first phase shifter and second phase shifter can control phase of the signal at a predetermined rate.

63. The method as recited in claim 60, wherein a number of the second divided signals is the same as a number of signals combinable by the first combiner.

64. The method as recited in claim 59, wherein a number of the first divided signals is settable based on variable range of the vertical half-power bean width of the input signal.

* * * * *

UNITED STATES PATENT AND TRADEMARK OFFICE

CERTIFICATE OF CORRECTION

PATENT NO. : 6,661,374 B2
DATED : December 9, 2003
INVENTOR(S) : D. Kim et al.

It is certified that error appears in the above-identified patent and that said Letters Patent is hereby corrected as shown below:

Column 22,
Line 13, “bean” should be -- beam --.

Column 24,
Line 63, “bean” should be -- beam --.

Signed and Sealed this

Seventh Day of September, 2004

JON W. DUDAS
*Director of the United States Patent and Trademark Office*